US008285169B2

(12) United States Patent
Shirai et al.

(10) Patent No.: US 8,285,169 B2
(45) Date of Patent: Oct. 9, 2012

(54) FEEDING APPARATUS AND IMAGE FORMING APPARATUS

(75) Inventors: Masakazu Shirai, Ebina (JP); Masaaki Tokunaga, Ebina (JP); Naoto Yoshino, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 260 days.

(21) Appl. No.: 12/784,216

(22) Filed: May 20, 2010

(65) Prior Publication Data

US 2011/0116824 A1 May 19, 2011

(30) Foreign Application Priority Data

Nov. 19, 2009 (JP) ..... 2009-263806

(51) Int. Cl.
*G03G 15/00* (2006.01)

(52) U.S. Cl. ..... 399/90; 399/107; 399/110; 399/121; 399/302

(58) Field of Classification Search ..... 399/90, 399/121, 107, 110, 302
See application file for complete search history.

(56) References Cited

U.S. PATENT DOCUMENTS

| | | | | |
|---|---|---|---|---|
| 7,555,238 | B2 * | 6/2009 | Igarashi | 399/121 |
| 2005/0008393 | A1 | 1/2005 | Kuma et al. | |
| 2006/0104094 | A1 * | 5/2006 | Kang et al. | 362/630 |

FOREIGN PATENT DOCUMENTS

| | | | |
|---|---|---|---|
| JP | 2004-347728 | A | 12/2004 |
| JP | 2005-037482 | A | 2/2005 |

* cited by examiner

*Primary Examiner* — Sophia S Chen
(74) *Attorney, Agent, or Firm* — Sughrue Mion, PLLC

(57) ABSTRACT

A feeding apparatus includes: an insulative feeding apparatus main body; plural first feeder lines; and a second feeder line, the feeding apparatus main body having: a first support member that supports the plural first feeder lines; and a second support member that supports the second feeder line, the first support member having: a wall surface part having a wall surface; and at least one projection projected from the wall surface in a direction crossing the wall surface, the plural first feeder lines being provided in space formed between the first support member and the second support member, and mutually partitioned from each other with the at least one projection, and the second feeder line being provided on a side of a surface of the second support member opposite to a surface on a side opposite to the plural first feeder lines.

11 Claims, 21 Drawing Sheets

FEEDING APPARATUS AND IMAGE FORMING APPARATUS

CROSS-REFERENCE TO RELATED APPLICATIONS

This application is based on and claims priority under 35 USC 119 from Japanese Patent Application No. 2009-263806 filed Nov. 19, 2009.

BACKGROUND

Technical Field

The present invention relates to a feeding apparatus and an image forming apparatus.

SUMMARY

According to an aspect of the present invention, there is provided a feeding apparatus including: an insulative feeding apparatus main body; plural first feeder lines used for supply of electric power; and a second feeder line used for supply of electric power at a voltage different from a voltage of the electric power respectively supplied with the plural first feeder lines, the feeding apparatus main body having: a first support member that supports the plural first feeder lines; and a second support member that supports the second feeder line, and the first support member having: a wall surface part having a wall surface; and at least one projection projected from the wall surface in a direction crossing the wall surface, the plural first feeder lines being provided in space formed between the first support member and the second support member, and mutually partitioned from each other with the at least one projection, and the second feeder line being provided on a side of a surface of the second support member opposite to a surface on a side opposite to the plural first feeder lines.

BRIEF DESCRIPTION OF THE DRAWINGS

An exemplary embodiment of the present invention will be described in detail based on the following figures, wherein.

DETAILED DESCRIPTION

Next, an exemplary embodiment of the present invention will be described based on the drawings.

Figure 1:
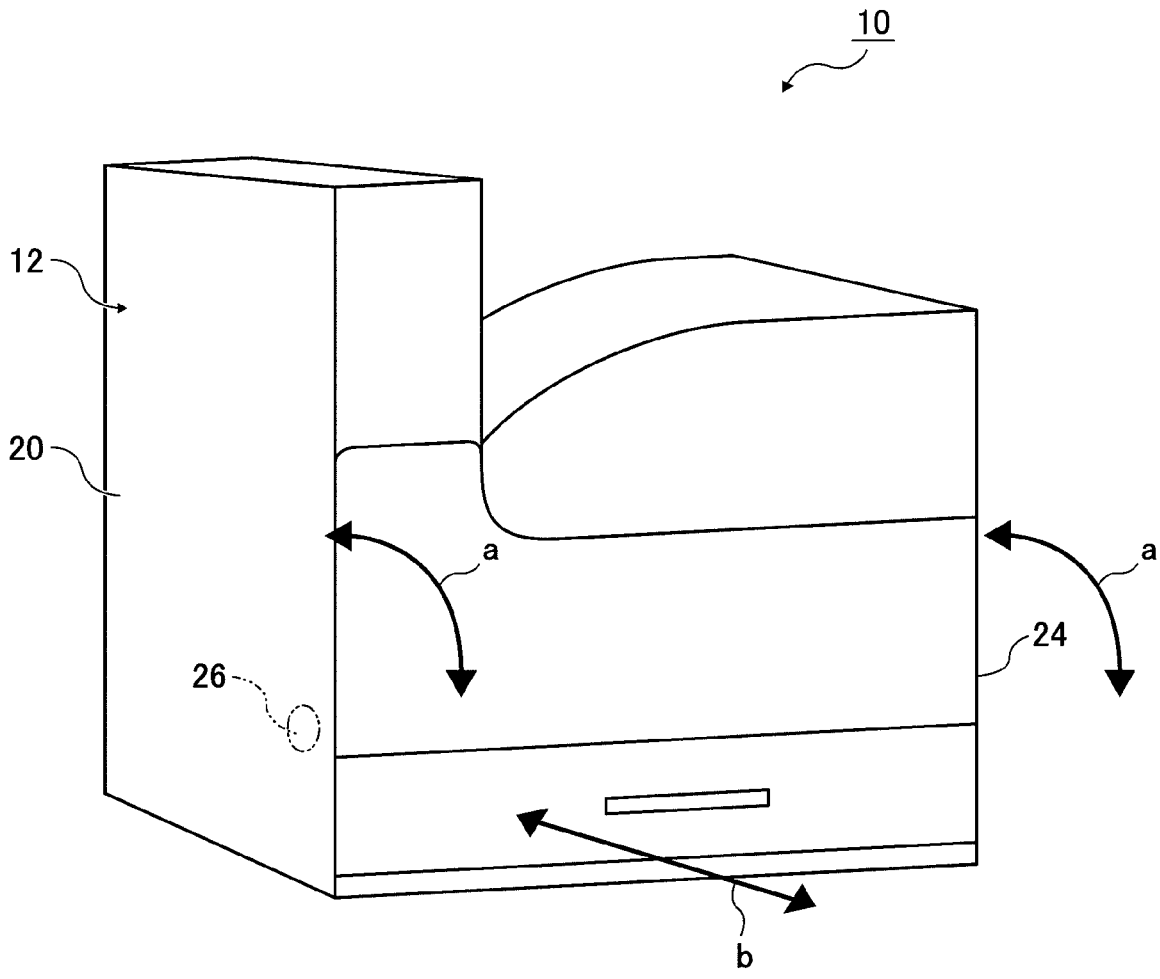
FIG. 1 is a perspective view showing an image forming apparatus according to an exemplary embodiment of the present invention.

FIG. 1 shows an image forming apparatus 10 according to an exemplary embodiment of the present invention.

As shown in FIG. 1, the image forming apparatus 10 has an image forming apparatus main body 12. The image forming apparatus main body 12 has a main body frame 30 (see FIG. 2) to be described later and an exterior cover 20 attached to the main body frame 30 so as to cover the outside of the main body frame 30. On the front surface side of the exterior cover 20, an opening/closing part 24 is attached using a hinge 26 so as to open/close with respect to the exterior cover 20. In FIG. 1, an arrow a indicates an opening/closing direction of the opening/closing part 24 with respect to the exterior cover 20. Further, an upper side of the image forming apparatus main body 12 is used as a discharge part 14 to which a recording medium on which an image is formed is discharged.

Further, e.g. a part of a recording medium feeding device 500 (see FIG. 3) to be described later can be pulled from the front surface side of the image forming apparatus main body 12. In FIG. 1, an arrow b indicates a direction in which the recording medium feeding device 500 is pulled from the image forming apparatus main body 12 and a direction in which the recording medium feeding device 500 pulled from the image forming apparatus main body 12 is attached in the image forming apparatus main body 12.

Figure 2:
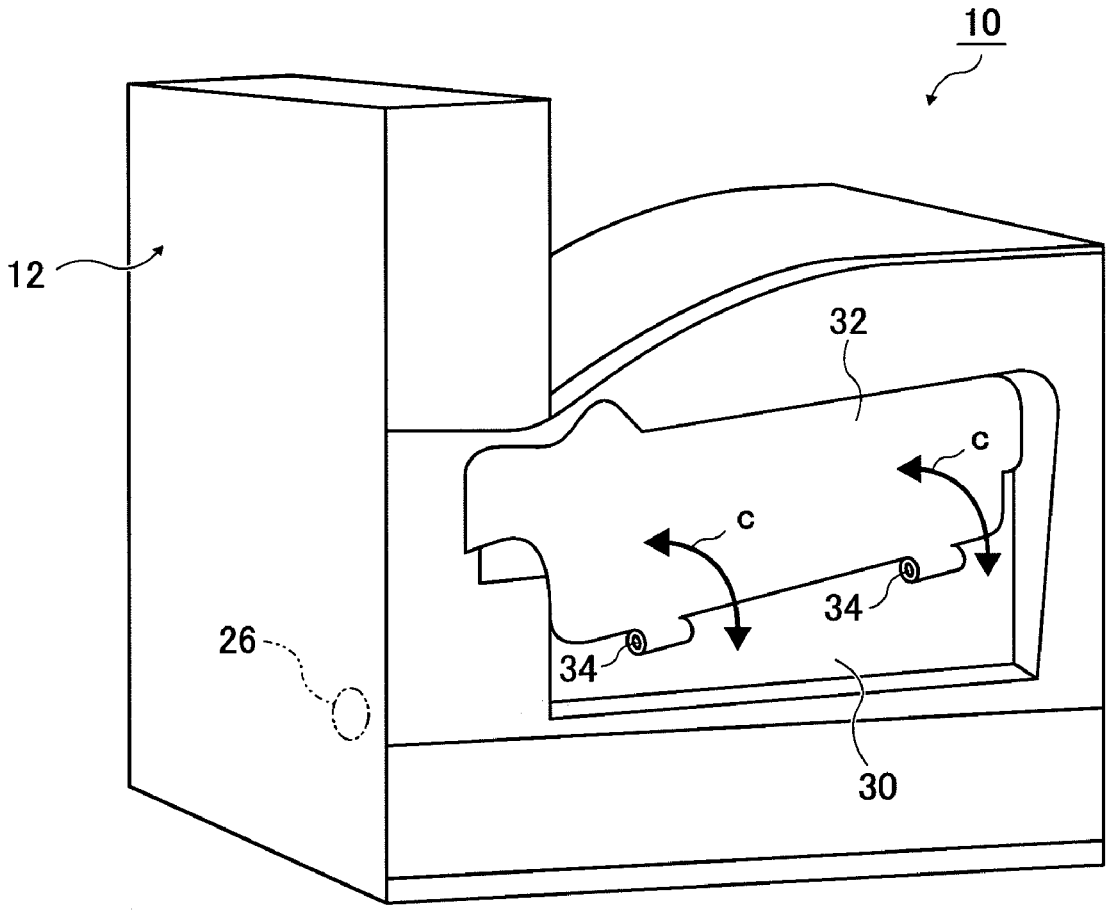
FIG. 2 is a perspective view showing a state where an opening/closing part is removed from an image forming apparatus main body shown in FIG. 1.

FIG. 2 shows a state where the opening/closing part (see FIG. 1) is removed from the image forming apparatus 10.

As described above, the image forming apparatus main body 12 has the main body frame 30. In the main body frame 30, an opening/closing frame 32 is attached to a part on the front surface side of the main body frame 30 which is exposed upon opening of the opening/closing part 24, using hinges 34, so as to open/close with respect to the main body frame 30. The opening/closing frame 32 is used as a side plate provided on the side of attachment/removal of a transfer unit 100 (see FIG. 3) to be described later, with respect to the transfer unit 100. In FIG. 2, an arrow c indicates an opening/closing direction of the opening/closing frame 32 with respect to the main body frame 30.

Figure 3:
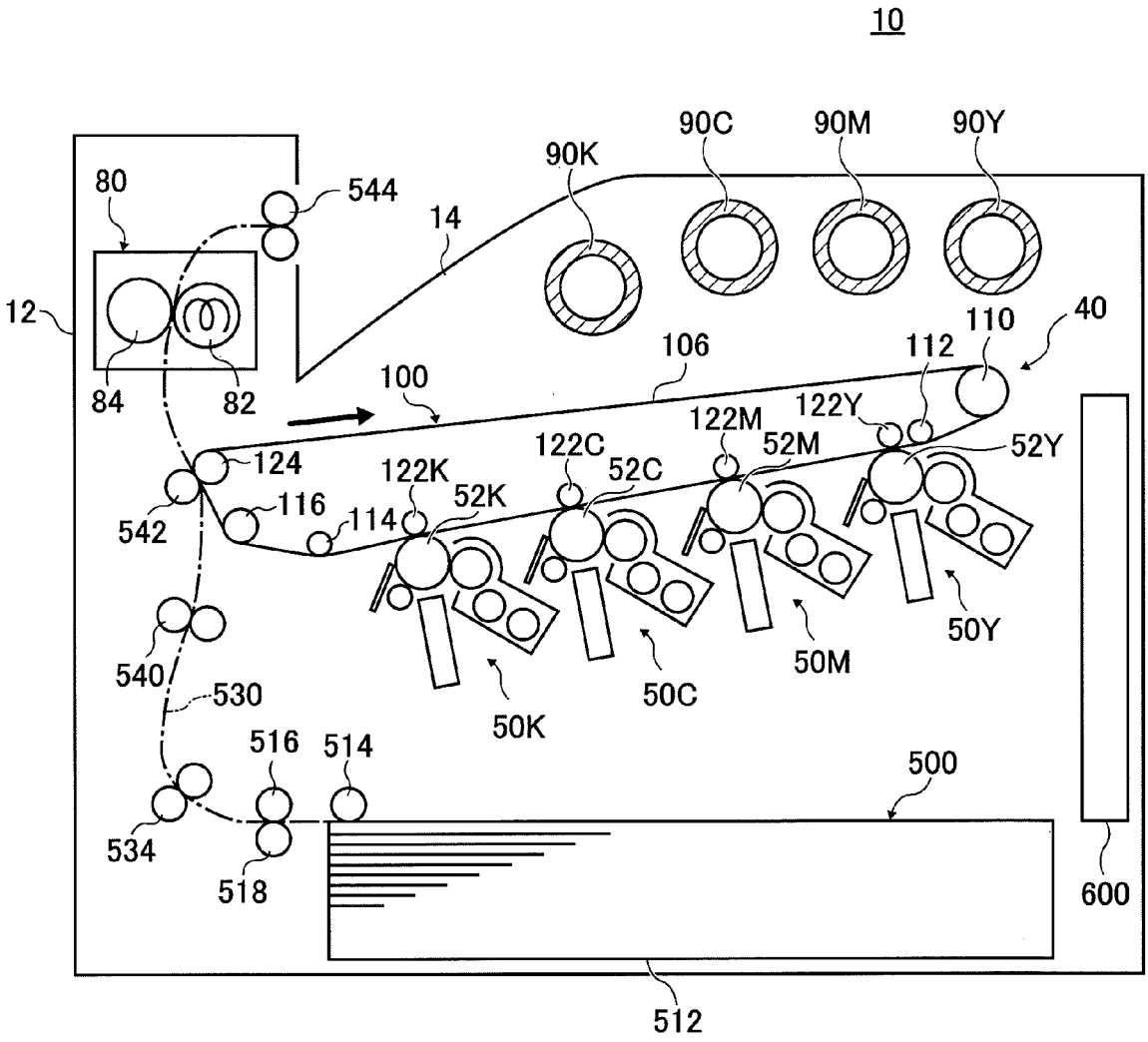
FIG. 3 is a cross-sectional view showing the image forming apparatus shown in FIG. 1 from a front position.

FIG. 3 is a cross-sectional view showing the image forming apparatus 10 from a front position.

As described above, the image forming apparatus 10 has the image forming apparatus main body 12, and an image forming part 40 to form an image on a recording medium, the recording medium feeding device 500 to supply a recording medium to the image forming part 40 and a power source device 600 are provided in the image forming apparatus main body 12. As a recording medium, normal paper, an OHP sheet or the like can be used. Further, a yellow developer container 90Y, a magenta developer container 90M, a cyan developer container 90C and a black developer container 90K are attached respectively removably in the image forming apparatus main body 12.

Yellow developer, magenta developer, cyan developer and black developer are respectively contained in the yellow developer container 90Y, the magenta developer container 90M, the cyan developer container 90C and the black developer container 90K. The contained yellow developer, magenta developer, cyan developer and black developer are respectively supplied to a developing device 58Y (see FIG. 4), a developing device 58M, a developing device 58C and a developing device 58K to be described later.

The image forming part 40 has a yellow image forming part 50Y, a magenta image forming part 50M, a cyan image forming part 50C, a black image forming part 50K, and the transfer unit 100. The yellow image forming part 50Y, the magenta image forming part 50M, the cyan image forming part 50C and the black image forming part 50K have photoreceptor drums 52Y, 52M, 52C and 52K respectively used as an image holder, and form a yellow developer image using yellow developer, a magenta developer image using magenta developer, a cyan developer image using cyan developer, and a black developer image using black developer. The details of the yellow image forming part 50Y, the magenta image forming part 50M, the cyan image forming part 50C and the black image forming part 50K will be described later.

The transfer unit 100, used as an attachable/removable structure attached/removed with respect to the image forming apparatus main body 12, is removed/attached with respect to the image forming apparatus main body 12 in a state where the opening/closing part 24 (see FIG. 1) is opened and the opening/closing frame 32 (see FIG. 2) is opened. Further, the transfer unit 100 has an intermediate transfer belt 106.

The intermediate transfer belt 106 is used as a conveyance member to convey at least one of developer images transferred from the photoreceptor drums 52Y, 52M, 52C and 52K and recording media on which the developer images are transferred from the photoreceptor drums 52Y, 52M, 52C and 52K, and used as a transfer body on which the images (developer images) held on the photoreceptor drums 52Y, 52M, 52C and 52K are transferred. Further, the intermediate transfer belt 106, which is an endless belt, is put around support rollers 110, 112, 114 and 116 and a second transfer roller 124 rotatably in an arrow direction in FIG. 3. The support roller 110 receives driving from a motor 36 (see FIG. 6) to be described later via a gear 130 (see FIG. 6) to be described later, and when the support roller 110 is rotated upon reception of the driving from the motor 36, the support roller 110 transmits the driving to the intermediate transfer belt 106.

Further, the transfer unit 100 has first transfer rollers 122Y, 122M, 122C and 122K. The first transfer rollers 122Y, 122M, 122C and 122K are respectively used as a first device at least one of in image formation and recording medium conveyance, and respectively transfer a yellow developer image, a magenta developer image, a cyan developer image and a black developer image formed on the surfaces of the photoreceptor drums 52Y, 52M, 52C and 52K to the intermediate transfer belt 106. The second transfer roller 124, used as a second device at least in one of image formation and recording medium conveyance, further transfers the yellow developer image, the magenta developer image, the cyan developer image and the black developer image transferred on the intermediate transfer belt 106 to the recording medium. The transfer unit 100 will be described later.

Further, the image forming apparatus main body 12 includes a fixing device 80 to fix a developer image transferred on a recording medium with the second transfer roller 124 to the recording medium. The fixing device 80 has a heating roller 82 with a heat source and a pressure roller 84 pressed against the heating roller 82, and fixes the developer image to the transfer medium using heat and pressure.

Further, the recording medium feeding device 500 to supply a recording medium to the image forming part 40 is attached in the image forming apparatus main body 12. As described above, the recording medium feeding device 500 can be pulled out to a position in front of the image forming apparatus main body 12 (front side in FIG. 3), and recording media are replenished in a state where the recording medium feeding device 500 is pulled out from the image forming apparatus main body 12.

The recording medium feeding device 500 has a recording medium container 512 to contain the recording media in stacked state. Further, the recording medium feeding device 500 has a conveyance roller 514 to extract the top recording medium in the recording medium container 512 and feed the extracted recording medium toward the image forming part 40. Further, the recording medium feeding device 500 has a retard roller 516 to retard a recording medium so as to prevent conveyance of plural recording media in overlapped state to the image forming part 40 and a press-contact roller 518 in press-contact with the retard roller 516.

Further, the image forming apparatus main body 12 includes a conveyance passage 530 used in conveyance of a recording medium. The conveyance passage 530 is used for conveyance of a recording medium supplied from the recording medium feeding device 500 to the image forming part 40, and discharge of the recording medium on which an image is formed to the outside of the image forming apparatus main body 12. The above-described conveyance roller 514, the retard roller 516 and the press-contact roller 518, a conveyance roller 534, a registration roller 540, the second transfer roller 124, an opposed roller 542 opposed via the intermediate transfer belt 106, the above-described fixing device 80, and a discharge roller 544 are provided along the conveyance passage 530 sequentially from the upstream side in a direction of conveyance of recording medium.

The registration roller 540 temporarily stops an end of a recording medium conveyed from the recording medium feeding device 500 side, then sends the recording medium toward a position between the second transfer roller 124 and the opposed roller 542 in correspondence with timing of transfer of respective color toner images to the intermediate transfer belt 106. The discharge roller 544 discharges the recording medium on which the respective color toner images are fixed with the fixing device 80 to the discharge part 14.

Figure 4:
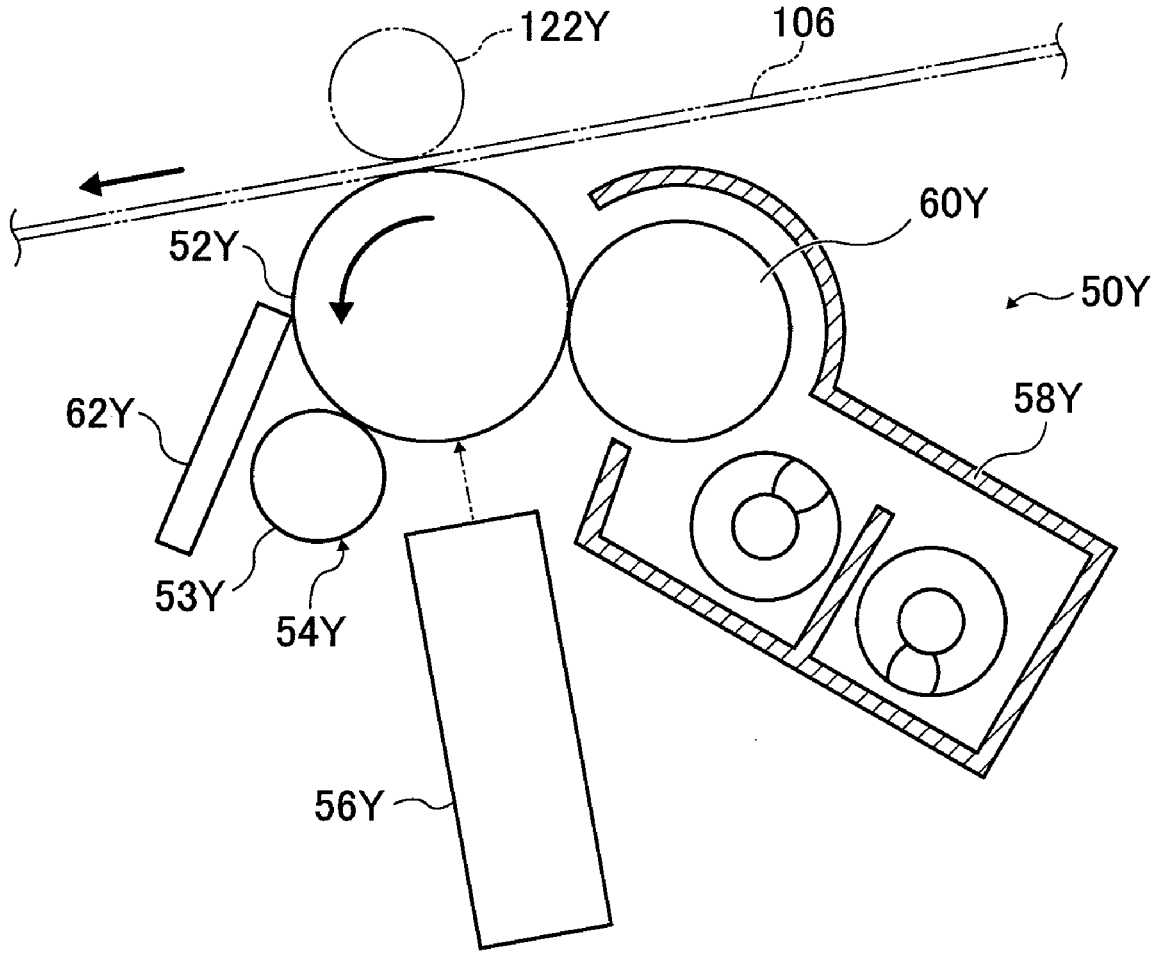
FIG. 4 is a cross-sectional view showing an image forming part of the image forming apparatus shown in FIG. 1 from a front position.

FIG. 4 shows the yellow image forming part 50Y. Note that the other image forming parts i.e. the magenta image forming part 50M, the cyan image forming part 50C and the black image forming part 50K use developer in different colors from that used in the yellow image forming part 50Y but have the same structure as that of the yellow image forming part 50Y to be described below, and accordingly, the explanations of the other image forming parts will be omitted.

As shown in FIG. 4, the yellow image forming part 50Y having the above-described photoreceptor drum 52Y further has a charging device 54Y, a latent image forming device 56Y, a developing device 58Y and a cleaning device 62Y. The charging device 54Y having e.g. a charging roller 53Y used as a charger to charge the photoreceptor drum 52Y, uniformly charges the surface of the photoreceptor drum 52Y. As the latent image forming device 56Y, e.g. an LED array is used. The latent image forming device 56Y irradiates the surface of the photoreceptor drum 52Y uniformly charged with the charging device 54Y with light, thereby forms a latent image on the surface of the photoreceptor drum 52Y. The developing device 58Y, having a developing roller 60Y used as a developer holder, supplies yellow developer with the developing roller 60Y to the photoreceptor drum 52Y, and develops the latent image formed on the surface of the photoreceptor drum 52Y with the yellow developer. The cleaning device 62Y, having e.g. a scraper, after transfer of the yellow developer image onto the intermediate transfer belt 106 with the first transfer roller 122Y, scrapes the yellow developer remaining on the surface of the photoreceptor drum 52Y with the scraper.

It may be arranged such that all or some of the photoreceptor drum 52Y, the charging device 54Y, the latent image forming device 56Y, the developing device 58Y and the cleaning device 62Y are integrated, and the yellow image forming part 50Y is an attachable/removable structure which can be attached/removed in the image forming apparatus main body 12.

Figure 5:
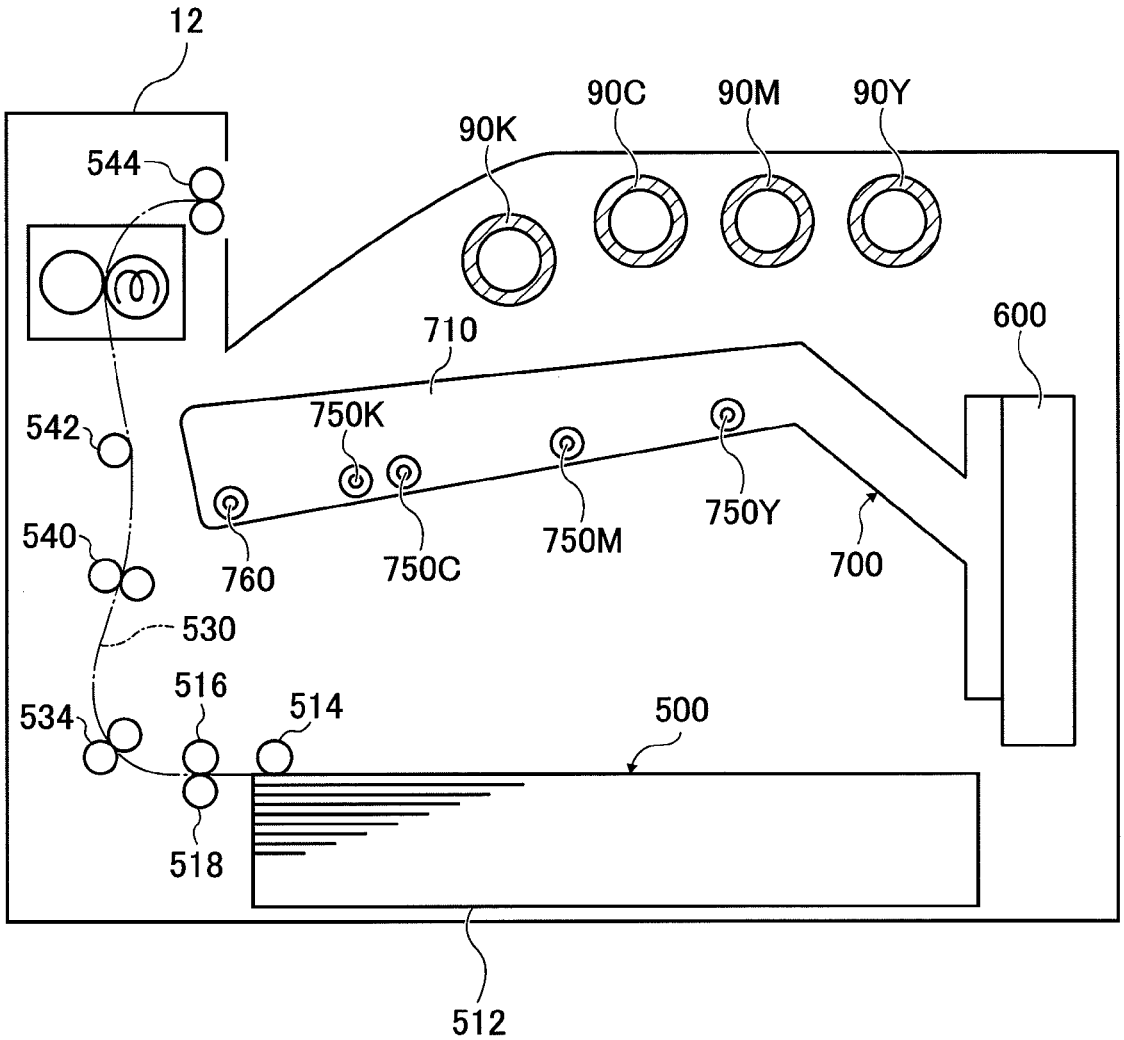
FIG. 5 is a cross-sectional view showing a state where the image forming part is removed from the image forming apparatus shown in FIG. 1, from a front position.

FIG. 5 shows a state where the image forming part 40 (the yellow image forming part 50Y, the magenta image forming part 50M, the cyan image forming part 50C, the black image forming part 50K and the transfer unit 100) is removed from the image forming apparatus main body 12 of the image forming apparatus 10. As shown in FIG. 5, the feeding device 700 is provided in the image forming apparatus main body 12. The feeding device 700 is used as a feeder to feed electric power to the first transfer rollers 122Y, 122M, 122C and 122K (see FIG. 3) and the second transfer roller 124 (see FIG. 3) from the power source device 600. Further, the feeding device 700 is positioned on the rear side of the transfer unit 100 (back side in FIG. 4) in a state where the transfer unit 100 is attached in the image forming apparatus main body 12.

Further, the feeding device 700, has a feeding device main body 710, and first feeding terminals 750Y, 750M, 750C and 750K, and a second feeding terminal 760 are attached in the feeding device main body 710 so as to be projected frontward (front side in FIG. 5) from the feeding device main body 710. The first feeding terminals 750Y, 750M, 750C and 750K are respectively connected to first feeder lines 730Y, 730M, 730C and 730K (see FIG. 9) to be described later, and respectively used as first feeding terminals connected to the first feeder lines. The second feeding terminal 760, connected to a second feeder line 732 (see FIG. 9) to be described later, is used as a second feeding terminal connected to the second feeder line.

Figure 6:
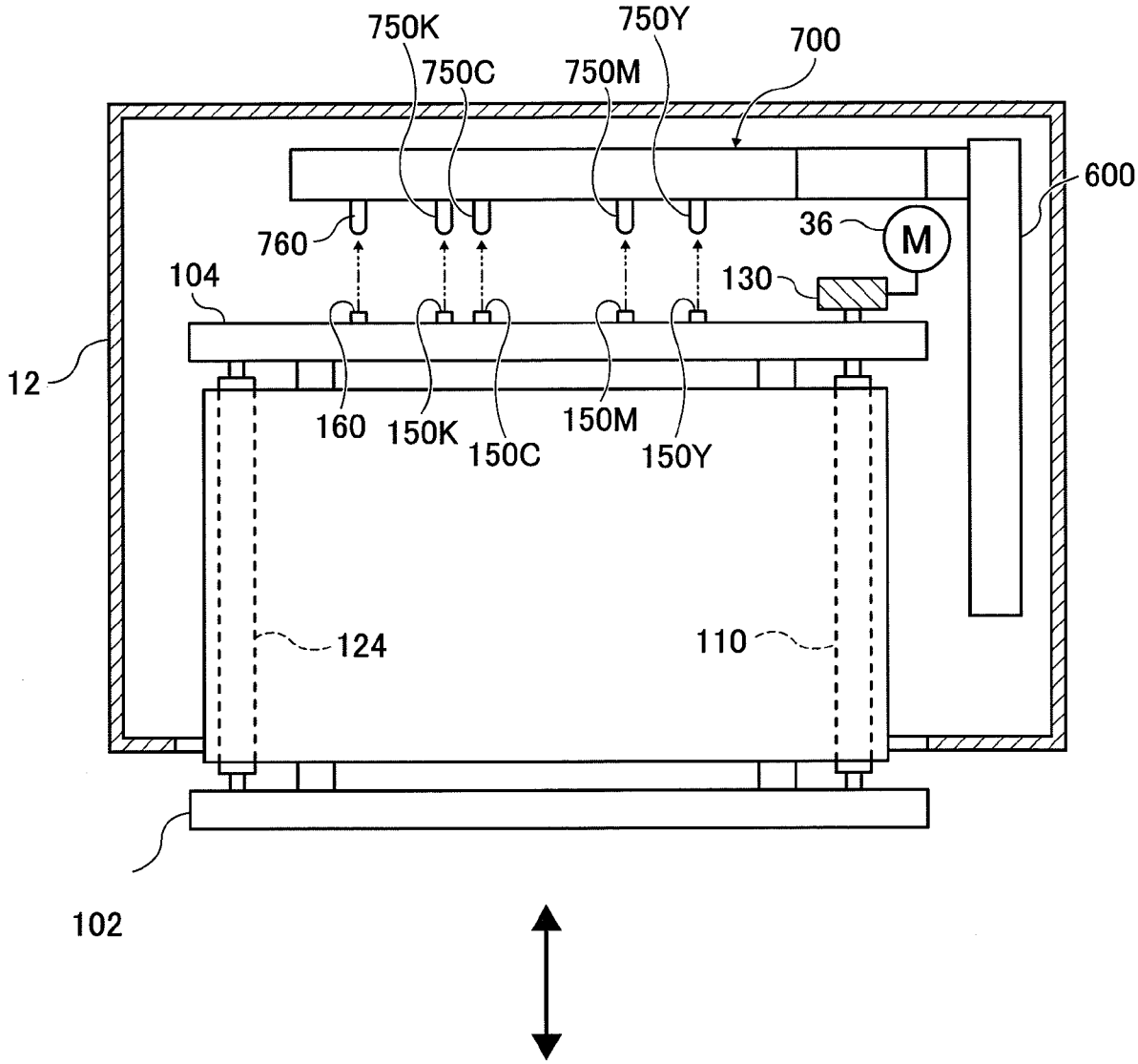
FIG. 6 is a plane view schematically showing attachment/removal of a transfer unit in the image forming apparatus main body of the image forming apparatus shown in FIG. 1.

FIG. 6 schematically shows the structure of the transfer unit 100 and attachment/removal of the transfer unit 100 in the image forming apparatus main body 12.

As shown in FIG. 6, the transfer unit 100 has a front side plate 102 positioned on the front side, and a rear side plate 104 connected to the front side plate 102 and positioned on the rear side of the front side plate 102, and provided in approximately parallel with the front side plate 102. The support roller 110 and the second transfer roller 124 are rotatably supported between the front side plate 102 and the rear side plate 104. Further, similarly to the support roller 110 and the second transfer roller 124, the first transfer rollers 122Y, 122M, 122C and 122K (see FIG. 3) and the support rollers 112, 144 and 116 (see FIG. 3) are rotatably supported between the front side plate 102 and the rear side plate 104.

Further, the transfer unit 100 has a gear 130 connected to the support roller 110. Upon attachment of the transfer unit 100 to the image forming apparatus main body 12 side, driving is transmitted from a motor 36 used as a driving source provided on the image forming apparatus main body 12 side to the gear 130.

Further, in the transfer unit 100, first feeding-receiving terminals 150Y, 150M, 150C and 150K and a second feeding-receiving terminal 160 are attached rearward to e.g. the rear side plate 104. The first feeding-receiving terminals 150Y, 150M, 150C and 150K are respectively electrically connected to the first transfer rollers 122Y, 122M, 122C and 122K (see FIG. 1). When the transfer unit 100 is attached in the image forming apparatus main body 12, the first feeding-receiving terminals 150Y, 150M, 150C and 150K are respectively in contact with the first feeding terminals 750Y, 750M, 750C and 750K, and respectively used as first feeding-receiving terminals fed with electric power from the first feeding terminals 750Y, 750M, 750C and 750K. Further, the second feeding-receiving terminal 160 is electrically connected to the second transfer roller 124. When the transfer unit 100 is attached in the image forming apparatus main body 12, the second feeding-receiving terminal 160 is in contact with the second feeding terminal 760, and is used as a second feeding terminal fed from the second feeding terminal 760.

Figure 7:
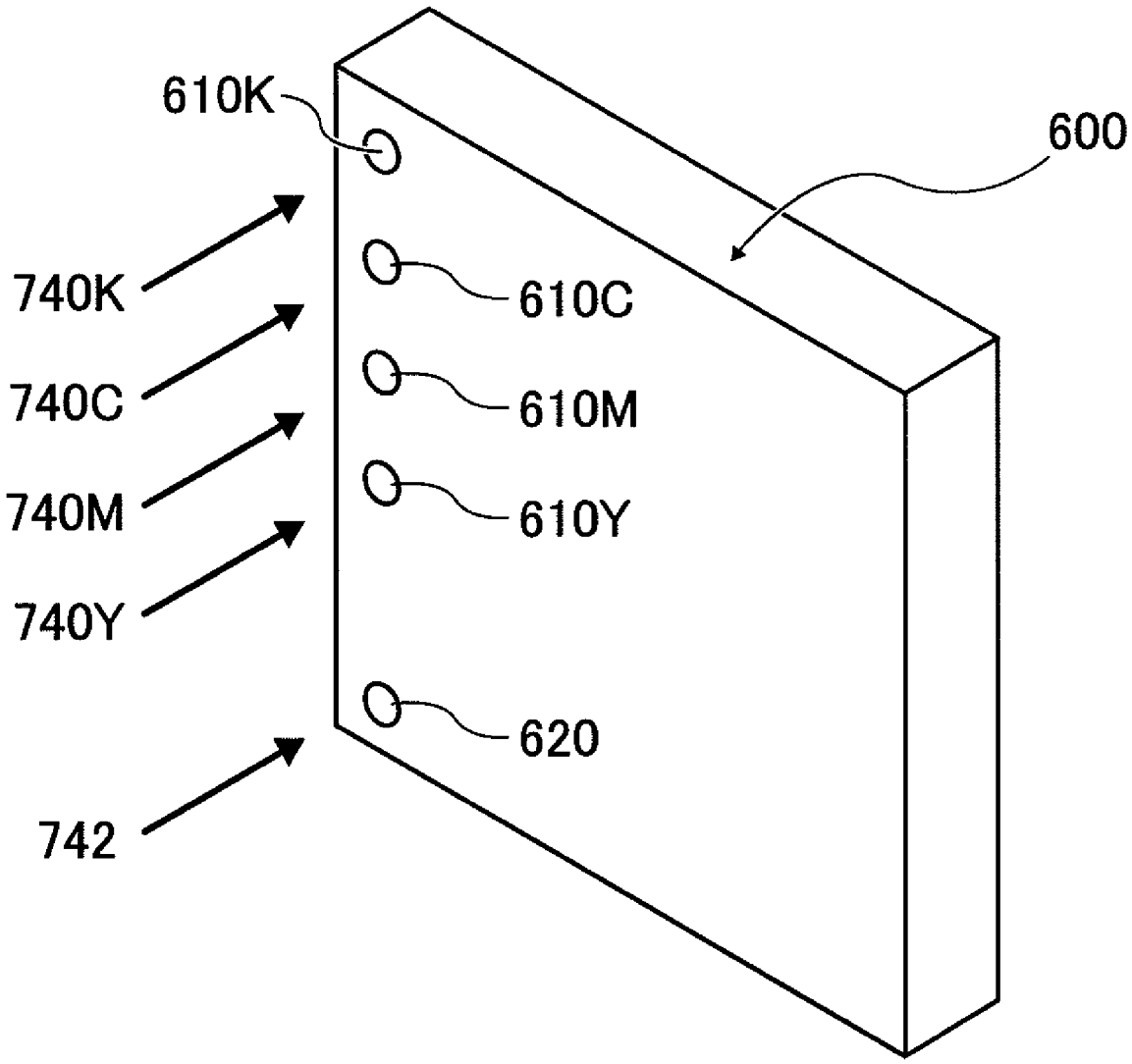
FIG. 7 is a perspective view showing a power source part of the image forming apparatus shown in FIG. 1.

FIG. 7 shows the power source device 600.

The power source device 600 is a high-voltage power source in which first power source terminals 610Y, 610M, 610C and 610K and a second power source terminal 620 are provided on the left surface side. The first power source terminals 610Y, 610M, 610C and 610K are electrically connected to the first feeder lines 730Y, 730M, 730C and 730K (see FIG. 9) to be described later. Further, the second power source terminal 620 is electrically connected to the second feeder line 732 (see FIG. 9) to be described later.

Figure 8:
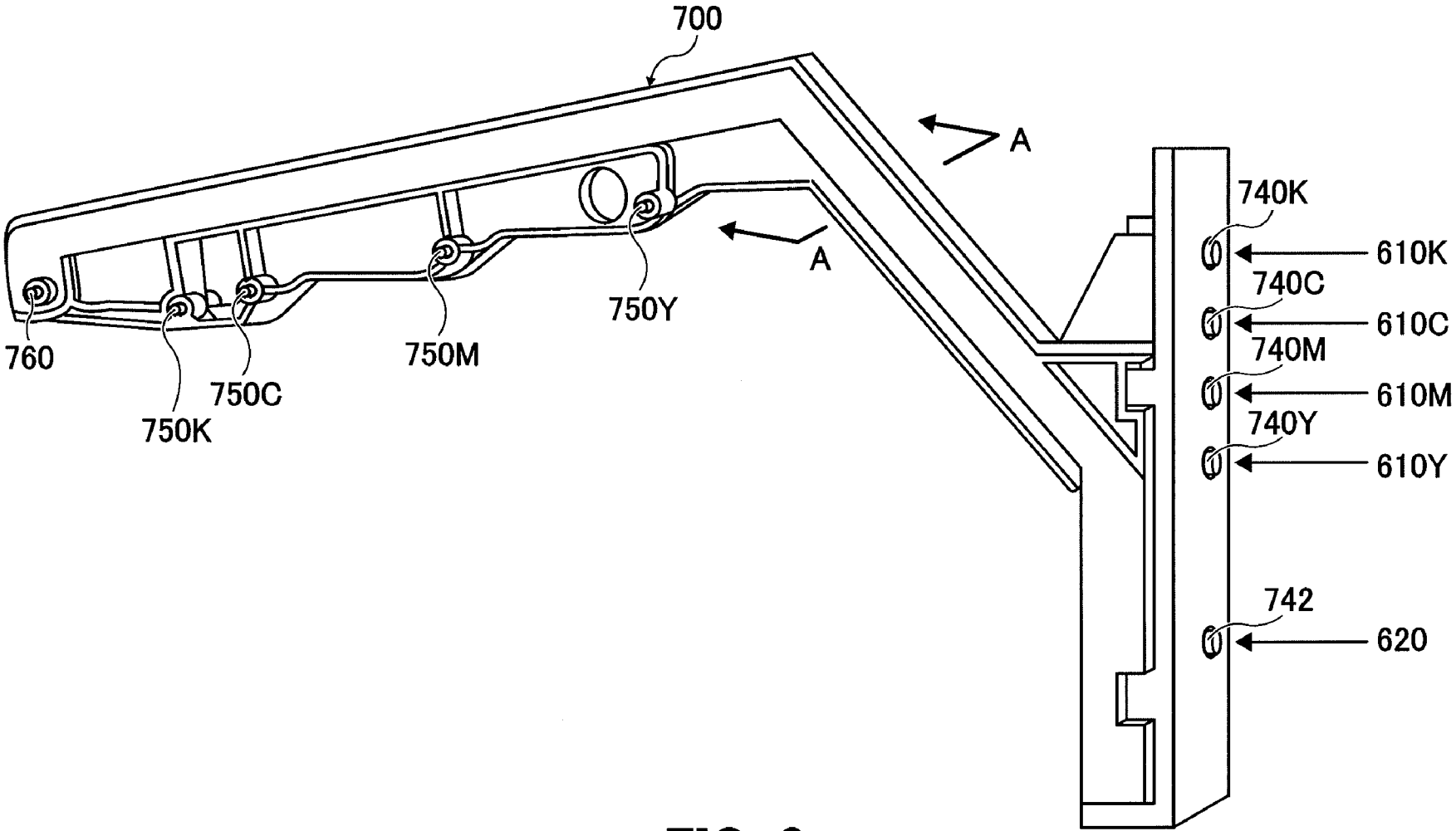
FIG. 8 is a perspective view showing a feeding apparatus according to the present exemplary embodiment of the present invention included in the image forming apparatus shown in FIG. 1.

FIG. 8 shows the feeding device 700.

As described above, the feeding device 700 has the feeding device main body 710.

The feeding device main body 710 is an insulative member formed of e.g. insulative material such as resin. The first feeding terminals 750Y, 750M, 750C and 750K and the second feeding terminal 760 are attached to the feeding device main body 710 so as to be projected frontward from the feeding device main body 710. Further, first power-source side terminals 740Y, 740M, 740C and 740K and a second power-source side terminal 742 are attached to the right side surface of the feeding device main body 710 so as to be projected from the right side surface of the feeding device main body 710.

The first feeding terminal 750Y and the first power-source side terminal 740Y are attached to the first feeder line 730Y (see FIG. 9) to be described later; the first feeding terminal 750M and the first power-source side terminal 740M are attached to the first feeder line 730M (see FIG. 9) to be described later; the first feeding terminal 750C and the first power-source side terminal 740C are attached to the first feeder line 730C (see FIG. 9) to be described later; and the first feeding terminal 750K and the first power-source side terminal 740K are attached to the first feeder line 730K (see FIG. 9) to be described later. Further, the first power-source side terminals 740Y, 740M, 740C and 740K are in contact with the first power source terminals 610Y, 610M, 610C and 610K of the power source device 600 in a state where the feeding device 700 is attached in the image forming apparatus main body 12. Further, the second power-source side terminal 742 is in contact with the second power source terminal 620 of the power source device 600 in a state where the feeding device 700 is attached in the image forming apparatus main body 12.

Figure 9:
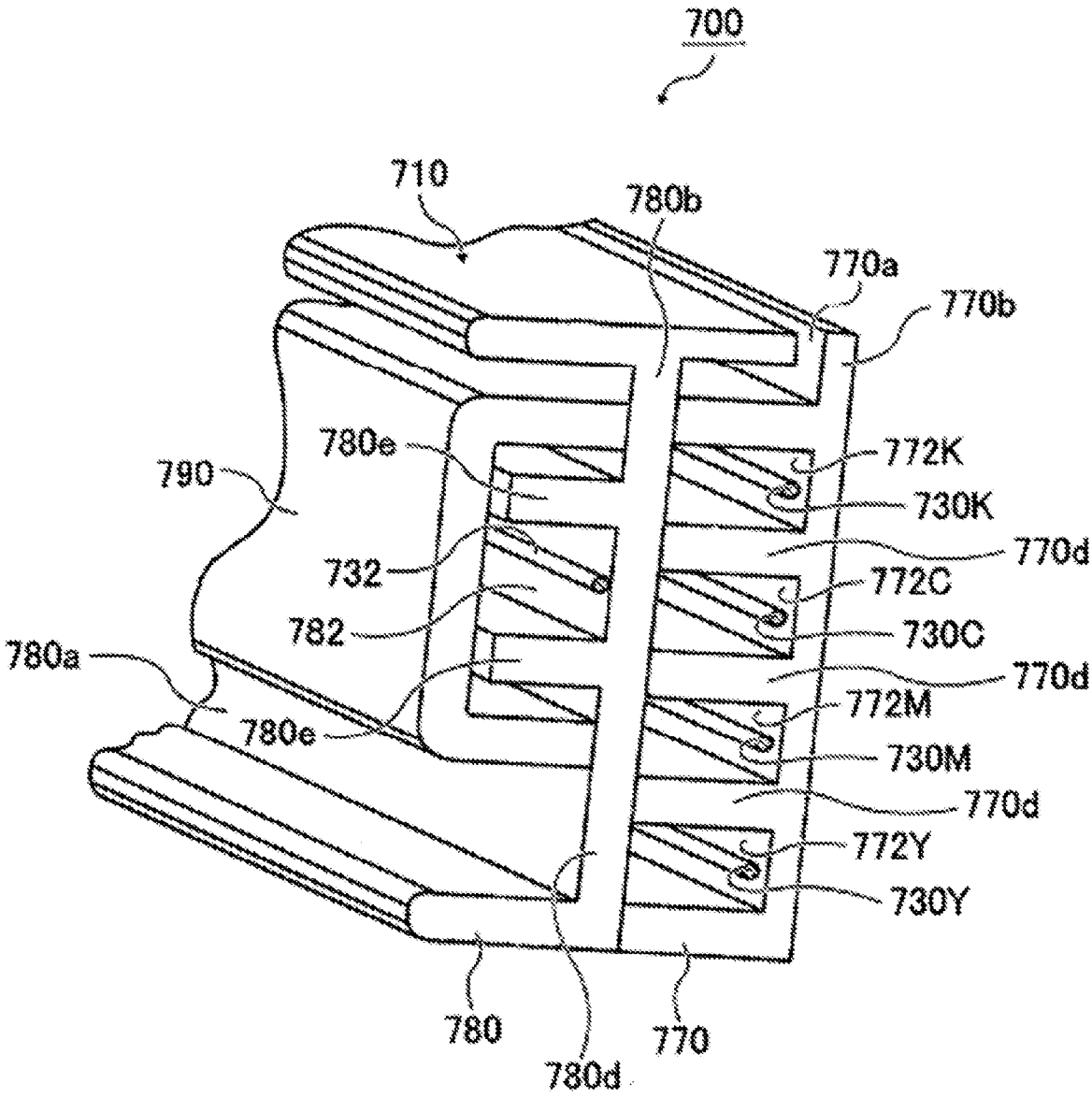
FIG. 9 is a cross-sectional view in a vertical surface of the feeding apparatus shown in FIG. 8 including a line A-A in FIG. 8.

FIG. 9 shows a cross section of the feeding device 700 in a vertical surface including a line A-A in FIG. 8.

As shown in FIG. 9, the feeding device main body 710, having a first main body member 770 provided on the rear side, a third main body member 790 positioned on the front side, and a second main body member 780 positioned between the first main body member 770 and the third main body member 790, is formed by assembling the first main body member 770, the second main body member 780 and the third main body member 790. Further, the feeding device 700 has the first feeder lines 730Y, 730M, 730C and 730K and the second feeder line 732.

The first main body member 770 is used as a first support member to support the first feeder lines 730Y, 730M, 730C and 730K used as plural first feeder lines. The second main body member 780 is used as a second support member to support the second feeder line 732 used as a second feeder line.

The first main body member 770 is formed by using insulative material such as resin.

Further, the first main body member 770 has a wall surface part 770*b* having a wall surface 770*a*, and a projection 770*d* projected from the wall surface 770*a* in a direction crossing the wall surface 770*a*. The first main body member 770 has at least one projection 770*d*. In the present exemplary embodiment, the first main body member 770 has three projections 770*d*, fewer than the four first feeder lines 730Y, 730M, 730C and 730K.

Further, in the first main body member 770, four grooves 772Y, 772M, 772C and 772K are formed toward the front side in positions among the projections 770*d* and positions outside the projections 770*d* positioned on both sides. The first feeder line 730Y is held in the groove 772K; the first feeder line 730M, in the groove 772M; the first feeder line 730C, in the groove 772C; and the first feeder line 730K, in the groove 772K. In this manner, the grooves 772Y, 772M, 772C and 772Y are respectively used as a first holding groove to hold the first feeder line. In other words, the first feeder lines 730Y, 730M, 730C and 730K are mutually partitioned with the projections 770*d*.

The second main body member 780 is formed by using insulative material such as resin.

The second main body member 780 has a wall surface part 780*d* having a wall surface 780*a*, and a surface of the wall surface part 780*d* on the rear side of the wall surface 780*a* is the wall surface 780*b*. Further, the second main body member 780 has, e.g., two projections 780*e* projected from the wall surface 780*a* in a direction crossing the wall surface 780*a*. A groove 782 is formed between the two projections 780*e*. The second feeder line 732 is held in the groove 782. In this manner, the groove 782 is used as a second holding groove to hold the second feeder line.

The third main body member 790 using an insulative member such as resin is attached to the second main body member 780 from the front side so as to cover the groove 782.

Note that using the second main body member 780 as a reference, the first feeder lines 730Y, 730M, 730C and 730K and the second feeder line 732 are provided on mutually opposite sides with respect to the wall surface part 780*d* of the second main body member 780. That is, the second feeder line 732 is provided on the side of the wall surface 780*a* as a surface opposite to the wall surface 780*b* as a surface opposite to the first feeder lines 730Y, 730M, 730C and 730K of the second main body member 780. Further, the first feeder lines 730Y, 730M, 730C and 730K are provided in space formed between the first main body member 770 and the second main body member 780.

The first feeder lines 730Y, 730M, 730C and 730K are respectively supported with the feeding device main body 710, and are used as first feeder lines to supply electric power to the first transfer rollers 122Y, 122M, 122C and 122K. Note that the voltage of the electric power supplied to the first transfer rollers 122Y, 122M, 122C and 122K using the first feeder lines 730Y, 730M, 730C and 730K is e.g. +3 kV.

The second feeder line 732 is supported with the feeding device main body 710, and used as a second feeder line to supply electric power to the second transfer roller 124. Note that the voltage of the electric power supplied to the second transfer roller 124 using the second feeder line 732 is e.g. −10 kV.

Figure 10:
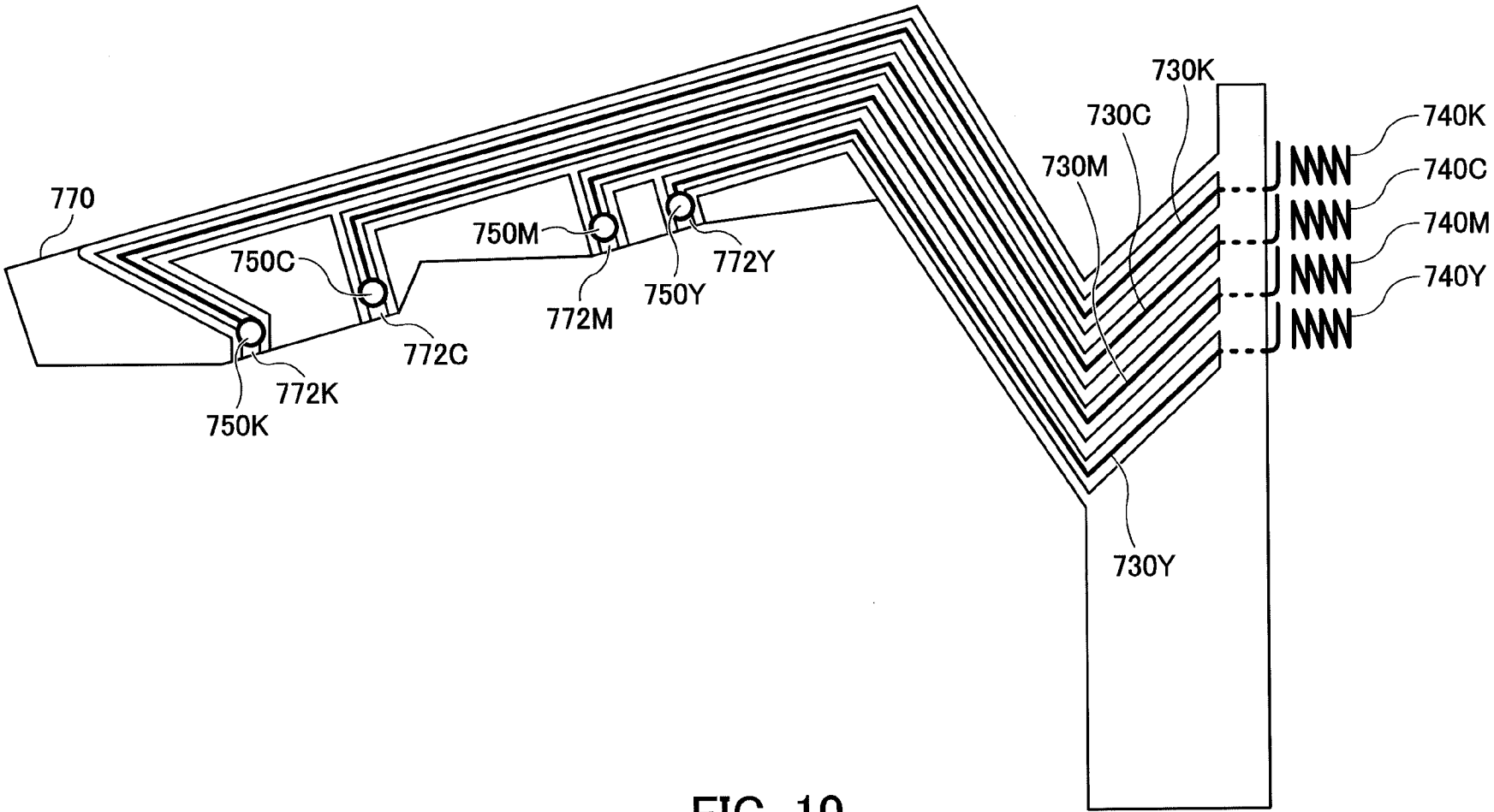
FIG. 10 is a front view showing a first main body member of the feeding apparatus shown in FIG. 8.

FIG. 10 is a front view showing the first main body member 770.

As shown in FIG. 10, the above-described grooves 772Y, 772M, 772C and 772K are formed in the first main body member 770, and the first feeder lines 730Y, 730M, 730C and 730K are held in the grooves 772Y, 772M, 772C and 772K. Further, the above-described first feeding terminals 750Y, 750M, 750C and 750K are respectively attached to ends of the first feeder lines 730Y, 730M, 730C and 730K. Further, the above-described first power-source side terminals 740Y, 740M, 740C and 740K are attached to the other ends of the first feeder lines 730Y, 730M, 730C and 730K. As the first power-source side terminals 740Y, 740M, 740C and 740K, an elastic-deformable member such as a coil spring can be used.

Figure 11:
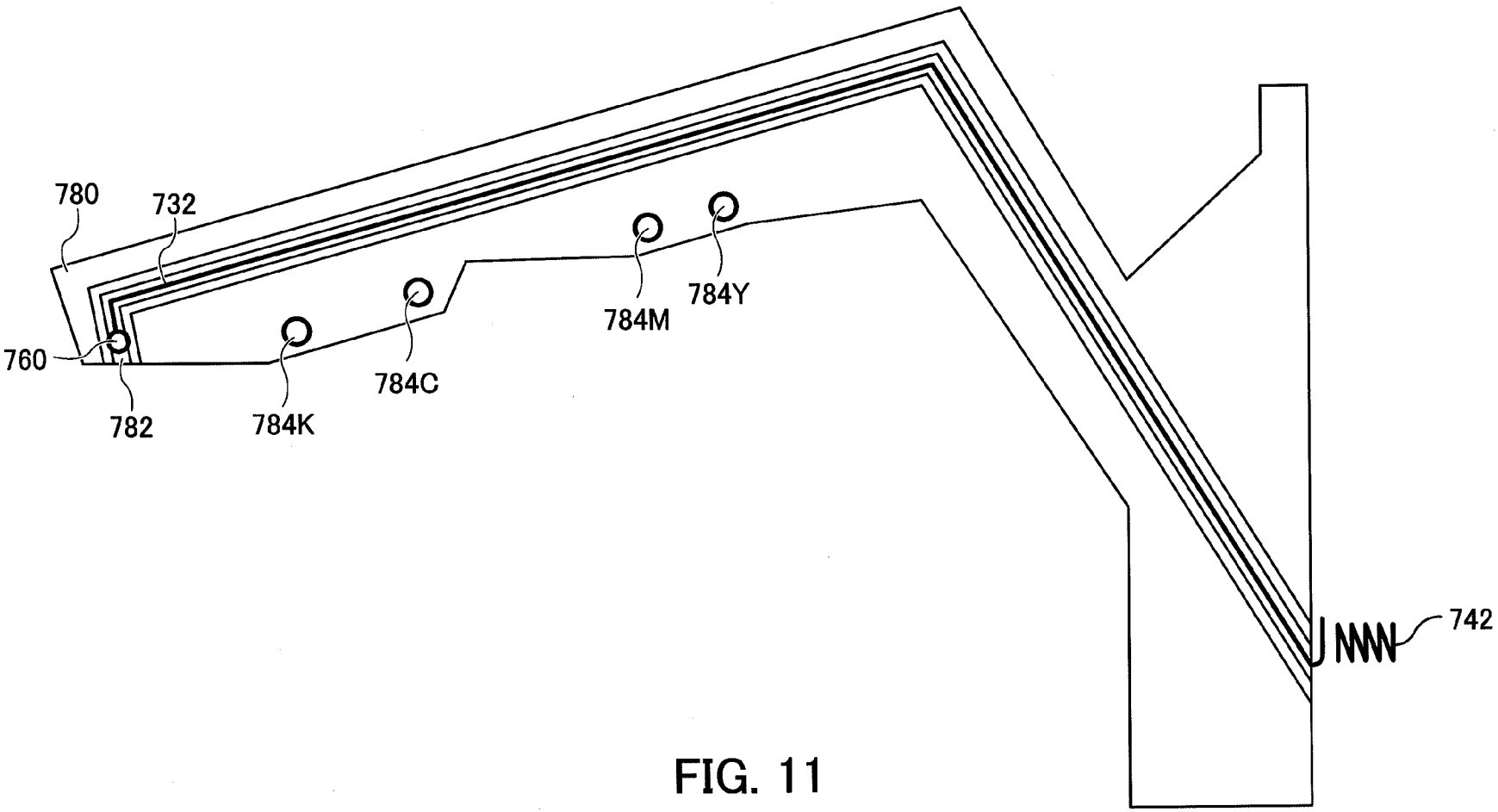
FIG. 11 is a front view showing a second main body member of the feeding apparatus shown in FIG. 8.

FIG. 11 is a front view showing the second main body member 780.

As shown in FIG. 11, the above-described groove 782 is formed in the second main body member 780, and the second feeder line 732 is held in the groove 782. Further, the above-described second feeding terminal 760 is attached to one end of the second feeder line 732. Further, the above-described second power-source side terminal 742 is attached to the other end of the second feeder line 732. As the second power-source side terminal 742, an elastic-deformable member such as a coil spring can be used. Further, through holes 784Y, 784M, 784C and 784K are formed in the second main body member 780 such that, when the front side of the first main body member 770 and the rear side of the second main body member 780 are overlapped, the first feeding terminals 750Y, 750M, 750C and 750K are respectively shot out toward the front side.

Figure 12:
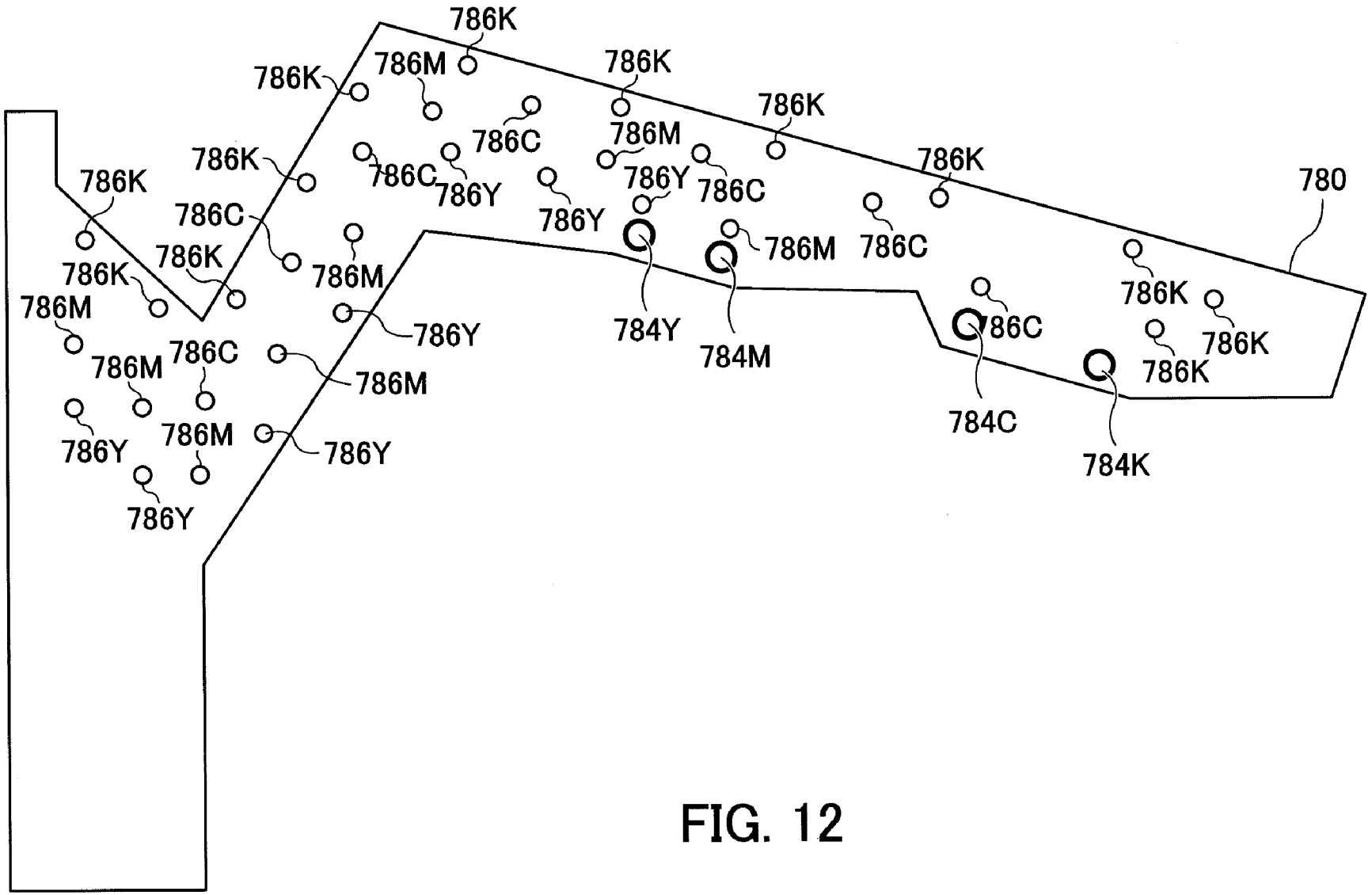
FIG. 12 is a rear view showing the second main body shown in FIG. 11.

FIG. 12 is a rear view showing the second main body member 780.

As shown in FIG. 12, e.g. plural convexes 786Y, 786M, 786C and 786K are formed on the rear surface of the second main body member 780. The convexes 786Y, 786M, 786C and 786K are used as first movement suppressing parts to suppress movement of the first feeder lines 730Y, 730M, 730C and 730K in a direction to move from the grooves 772Y, 772M, 772C and 772K. When the front side of the first main body member 770 and the rear side of the second main body member 780 are overlapped, the convexes 786Y, 786M, 786C and 786K are respectively inserted in the grooves 772Y, 772M, 772C and 772K, and suppress movement of the first feeder lines 730Y, 730M, 730C and 730K.

Figure 13:
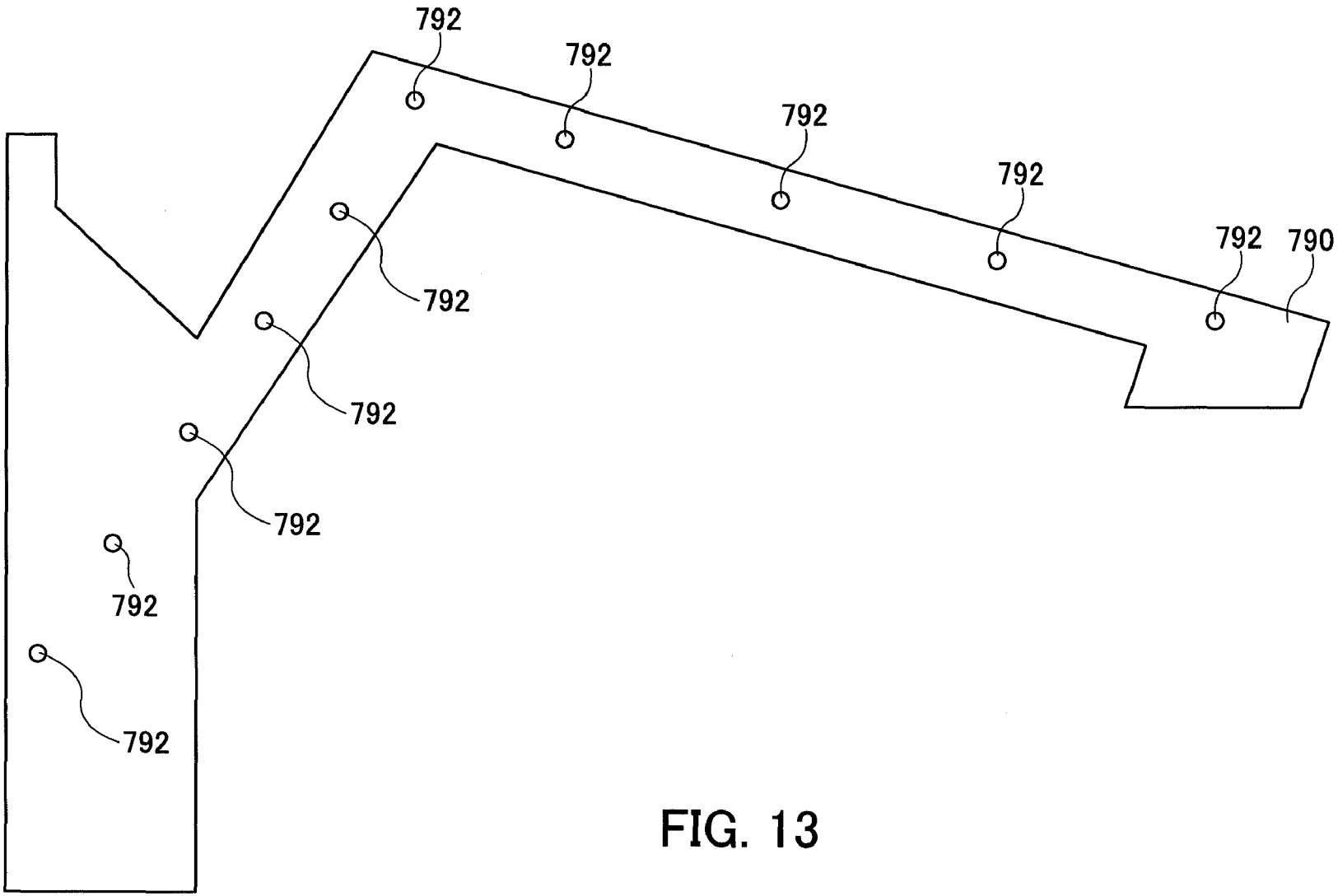
FIG. 13 is a rear view showing a third main body member of the feeding apparatus shown in FIG. 8.

FIG. 13 is a rear view showing the third main body member 790.

As shown in FIG. 13, e.g. plural convexes 792 are formed in the rear surface of the third main body member 790. The convexes 792 are used as second movement suppressing parts to suppress movement of the second feeder line 732 in a direction to move from the groove 782. When the front side of the second main body member 780 and the rear side of the third main body member 790 are overlapped, the convex 792 is inserted in the groove 782 thereby suppresses movement of the second feeder line 732.

As described above, in the image forming apparatus 10 according to the present exemplary embodiment, both of the grooves 772Y, 772M, 772C and 772K to hold the first feeder lines 730Y, 730M, 730C and 730K, and the groove 782 to hold the second feeder line 732 are formed in the feeding device main body 710. However, since it is sufficient to form at least one of the grooves 772Y, 772M, 772C and 772K and the groove 782, it may be arranged such that only the grooves 772Y, 772M, 772C and 772K are formed or only the groove 782 is formed.

Further, as described above, in the image forming apparatus 10 according to the present exemplary embodiment, both of the convexes 786Y, 786M, 786C and 786K to suppress movement of the first feeder lines 730Y, 730M, 730C and 730K in a direction to move from the grooves 772Y, 772M, 772C and 772K and the convex 792 to suppress movement of the second feeder line 732 in a direction to move from the groove 782 are formed in the feeding device main body 710. However, since it is sufficient to form at least one of the convexes 786Y, 786M, 786C and 786K and the convex 792, it may be arranged such that only the convexes 786Y, 786M, 786C and 786K are formed or only the convex 792 is formed.

Figure 14:
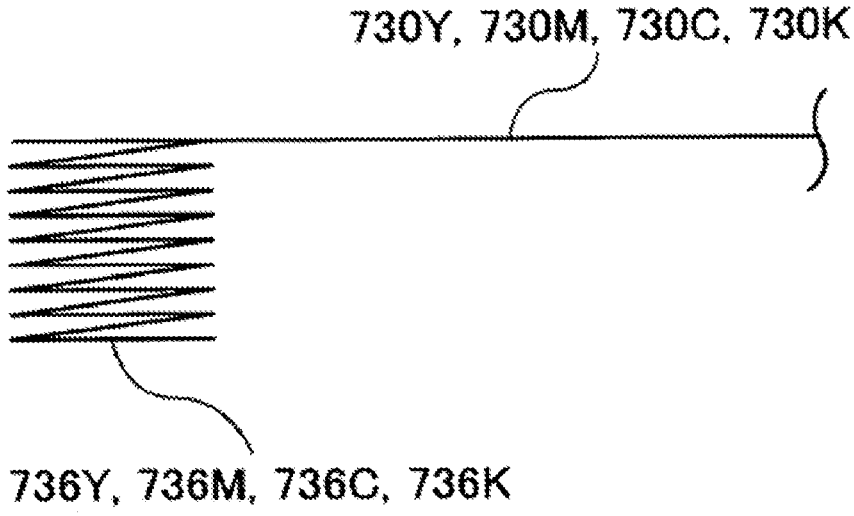
FIG. 14 is a plane view showing a first feeder line of the feeding apparatus shown in FIG. 8.

FIG. 14 shows an enlarged view of the end of the first feeder line 730Y to which the first feeding terminal 750Y is attached.

As shown in FIG. 14, at the end of the first feeder line 730Y to which the first feeding terminal 750Y is attached, a first pressing part 736Y used as a first terminal pressing part to press the first feeding terminal 750Y (see FIG. 6) against the first feeding-receiving terminal 150Y (see FIG. 6) is provided. The first pressing part 736 which is a part of e.g. the first feeder line 730Y is formed by e.g. processing the end of the first feeder line 730Y into a coil spring shape as shown in FIG. 14.

As in the case of the end of the first feeder line 730Y to which the first feeding terminal 750Y is attached, where the first pressing part 736Y to press the first feeding terminal 750Y against the first feeding-receiving terminal 150Y (see FIG. 6) is provided, first pressing parts 736M, 736C and 736K to press the first feeding terminals 750M, 750C and 750K against the first feeding-receiving terminals 150M, 150C and 150K (see FIG. 6) are provided at the ends of the first feeder lines 730M, 730C and 730K to which the first feeding terminals 750M, 750C and 750K are attached.

Figure 16:
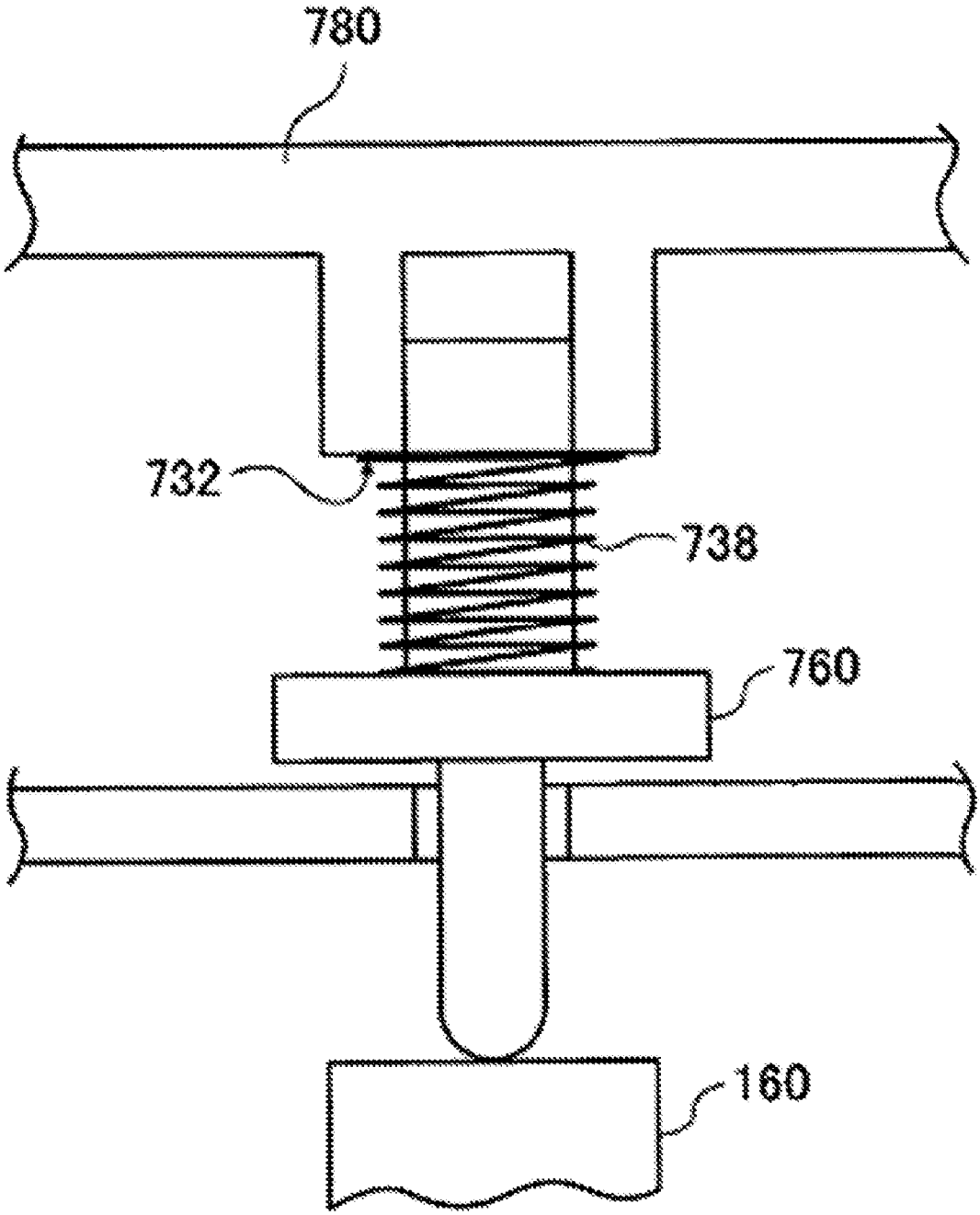
FIG. 16 is a plane view showing a peripheral portion of a second feeding terminal of the feeding apparatus shown in FIG. 8.

As in the case of the end of the first feeder line 730Y to which the first feeding terminal 750Y is attached, where the first pressing part 736Y to press the first feeding terminal 750Y against the first feeding-receiving terminal 150Y is provided, at the end of the second feeder line 732 to which the second feeding terminal 760 is attached, a second pressing part 738 used as a second terminal pressing part to press the second feeding terminal 760 against the second feeding-receiving terminal 160 is provided (see FIG. 16).

Further, as described above, in the image forming apparatus 10 according to the present exemplary embodiment, both of the first pressing parts 736Y, 736M, 736C and 736K and the second pressing part 738 are formed. However, since it is sufficient to form at least one of the first pressing parts 736Y, 736M, 736C and 736K and the second pressing part 738, it may be arranged such that only the first pressing parts 736Y, 736M, 736C and 736K are formed or only the second pressing part 738 is formed.

Figure 15:
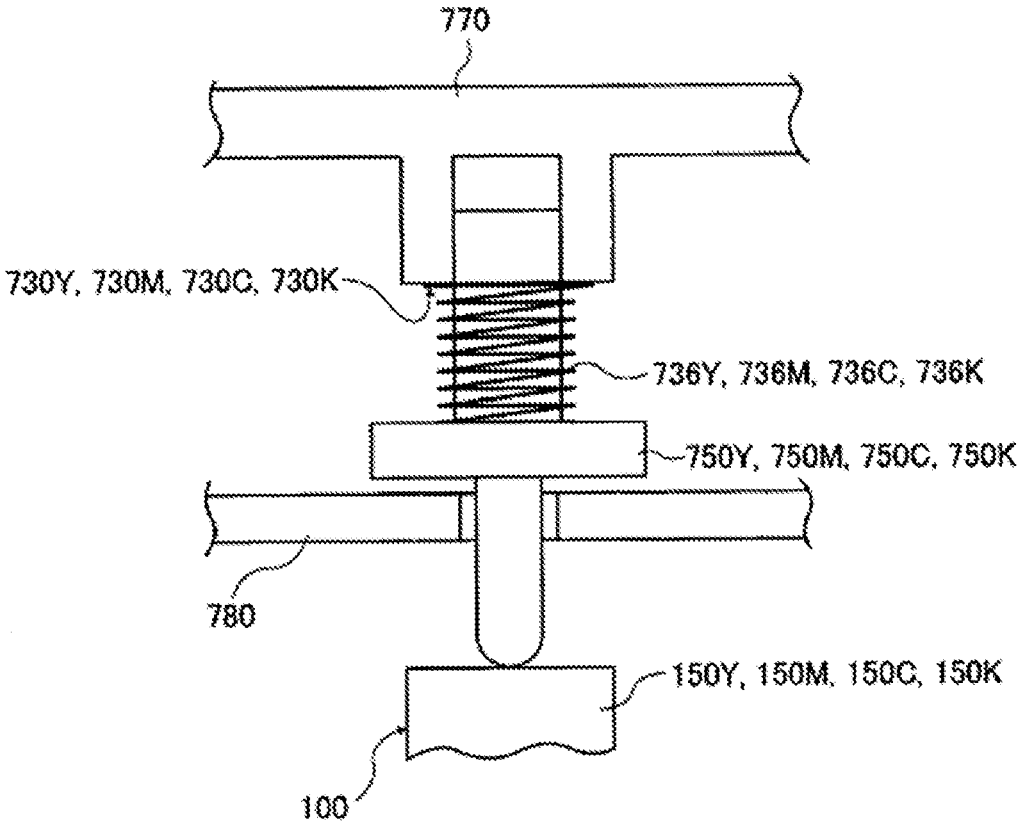
FIG. 15 is a plane view showing a peripheral portion of a first feeding terminal of the feeding apparatus shown in FIG. 8.

FIG. 15 is a plane view showing an enlarged view of a peripheral portion of the first feeding terminals 750Y, 750M, 750C and 750K.

As shown in FIG. 15, the first feeding terminals 750Y, 750M, 750C and 750K are respectively attached to the first pressing parts 736Y, 736M, 736C and 736K held with the first main body member 770. The first pressing parts 736Y, 736M, 736C and 736K press the respective first feeding terminals 750Y, 750M, 750C and 750K against the first feeding-receiving terminals 150Y, 150M, 150C and 150K.

FIG. 16 is a plane view showing an enlarged view of a peripheral portion of the second feeding terminal 760.

As shown in FIG. 16, the second feeding terminal 760 is attached to the second pressing part 738 held with the second main body member 780. The second pressing part 738 presses the second feeding terminal 760 against the second feeding-receiving terminal 160.

Further, when the first pressing parts 736Y, 736M, 736C and 736K press the respective first feeding terminals 750Y, 750M, 750C and 750K against the first feeding-receiving terminals 150Y, 150M, 150C and 150K, the transfer unit 100 is pressed to the front side, and the transfer unit 100 is pressed against the opening/closing frame 32 (see FIG. 2) used as a side plate. Further, when the second pressing part 738 presses the second feeding terminal 760 against the second feeding-receiving terminal 160, the transfer unit 100 is pressed to the front side, and the transfer unit 100 is pressed against the opening/closing frame 32 used as a side plate.

Figure 17:
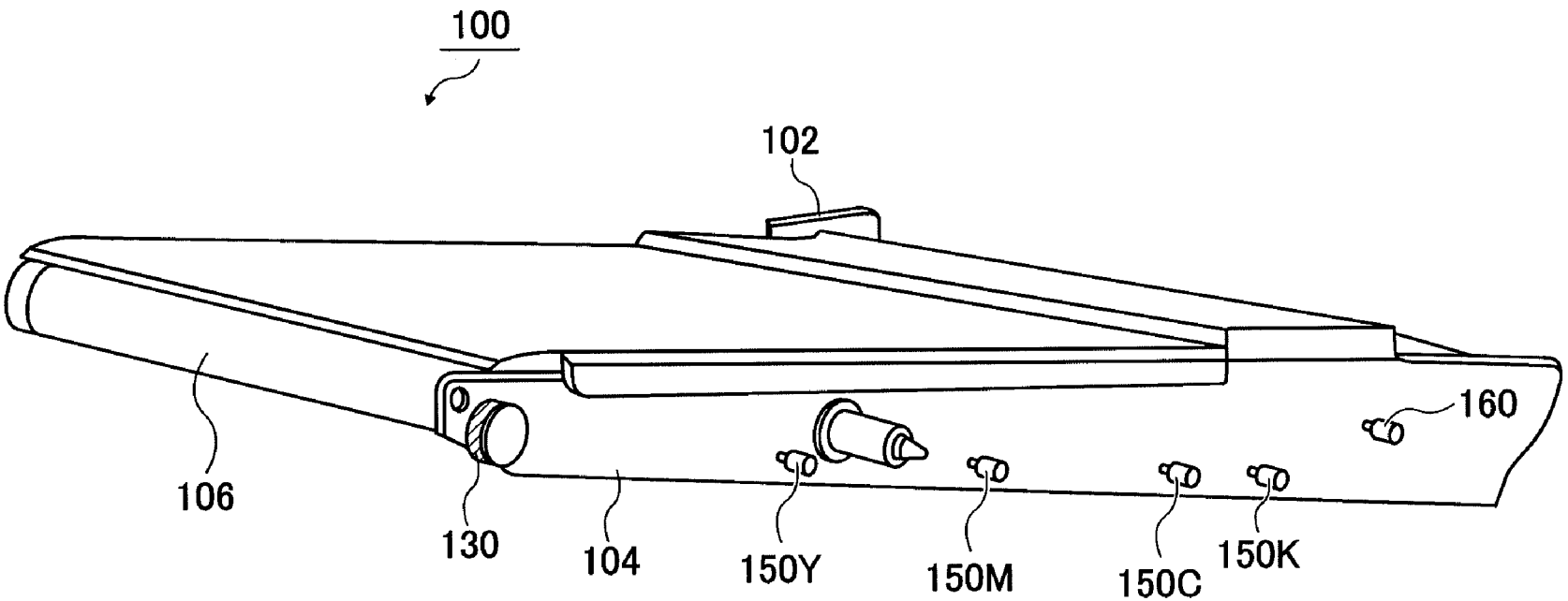
FIG. 17 is a perspective view showing a transfer unit of the image forming apparatus shown in FIG. 1.
Figure 18:
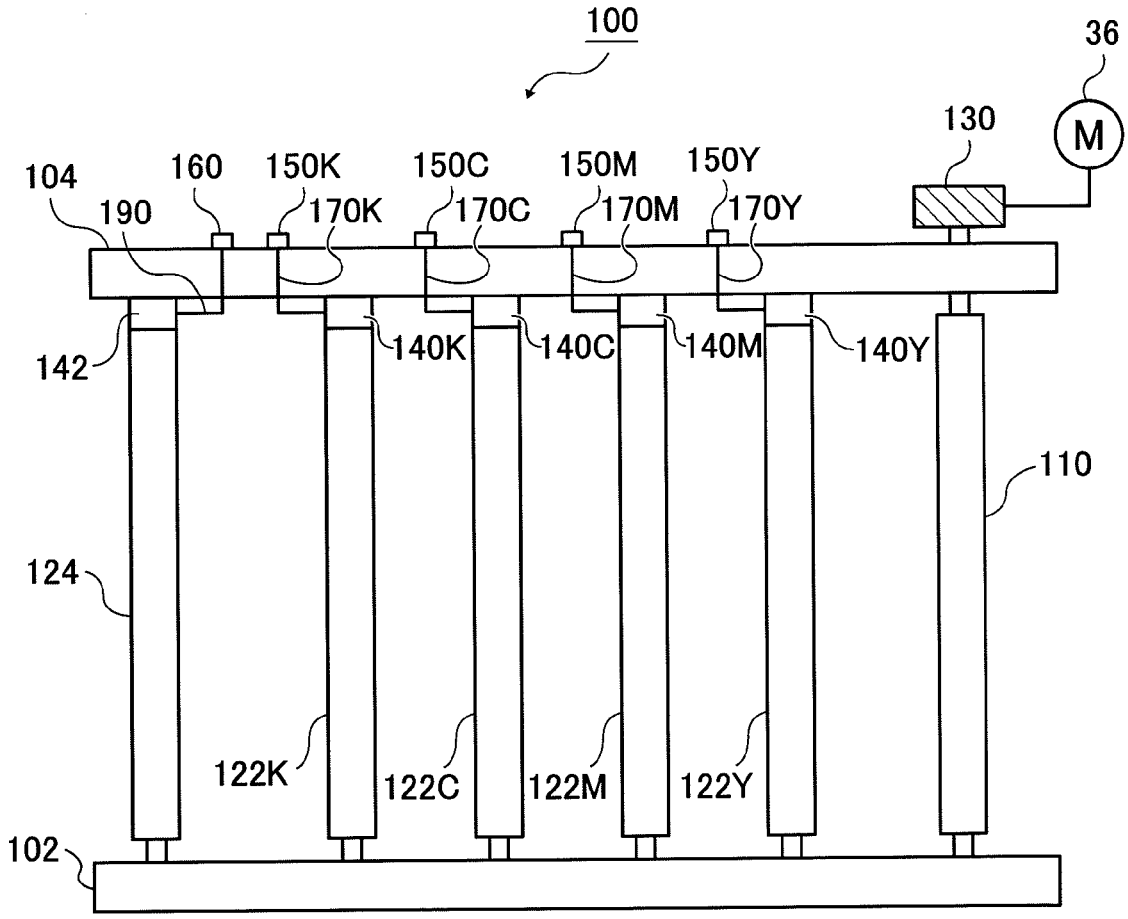
FIG. 18 is a plane view schematically showing a state where an intermediate transfer belt is removed from the transfer unit shown in FIG. 17.

FIGS. 17 and 18 show the transfer unit 100.

As described above, the first transfer rollers 122Y, 122M, 122C and 122K and the second transfer roller 124 are rotatably supported with the front side plate 102 and the rear side plate 104. At this time, the first transfer rollers 122Y, 122M, 122C and 122K are supported with the rear side plate 104 using bearings 140Y, 140M, 140C and 140K having conductivity. Further, the second transfer roller 124 is supported with the rear side plate 104 using a bearing 142 having conductivity.

The bearings 140Y, 140M, 140C and 140K are respectively electrically connected to the first feeding-receiving terminals 150Y, 150M, 150C and 150K using conductive parts 170Y, 170M, 170C and 170K. Further, the bearing 142 is electrically connected to the second feeding-receiving terminal 160 using a conductive part 190.

Figure 19:
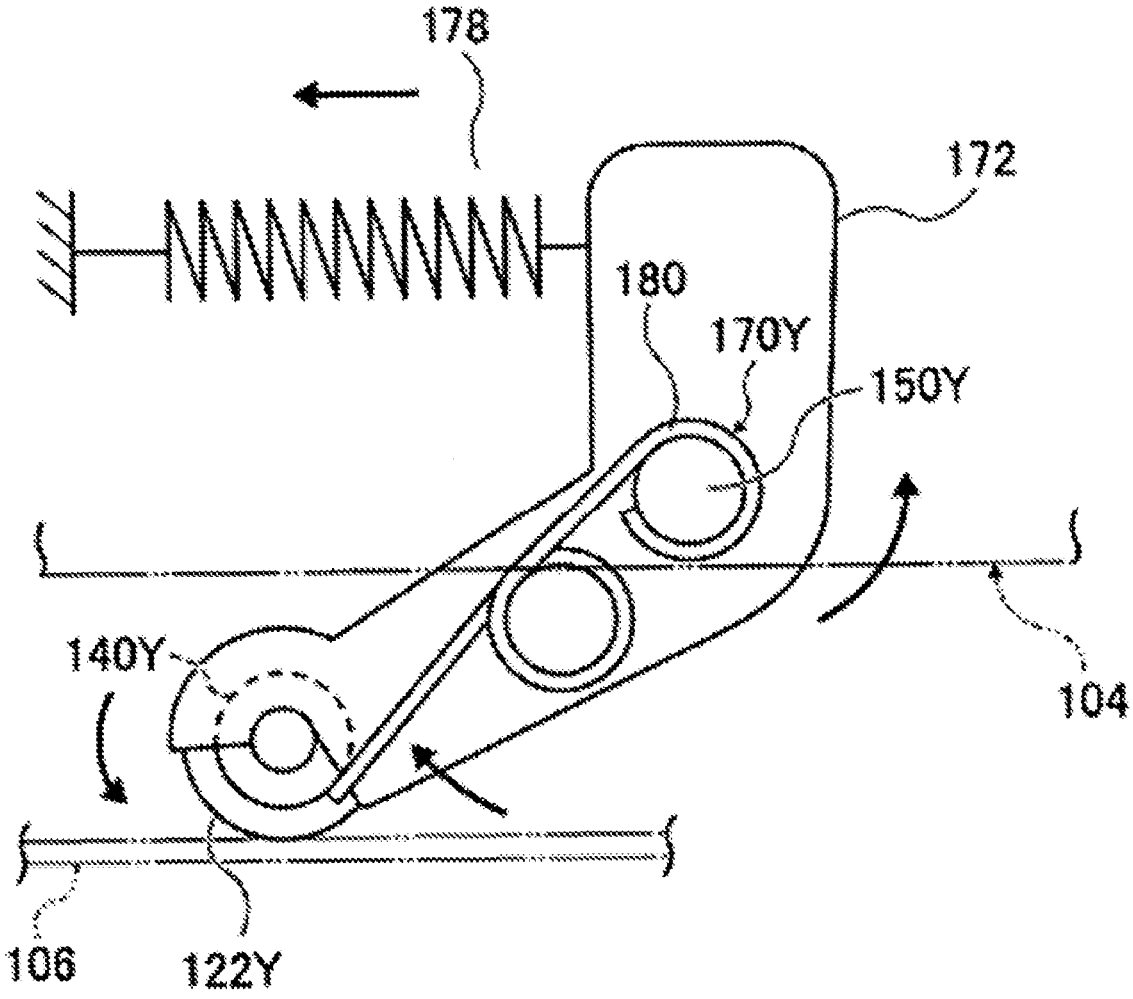
FIG. 19 is a front view showing a structure around a first feeding-receiving terminal of the transfer unit shown in FIG. 17.
Figure 20:
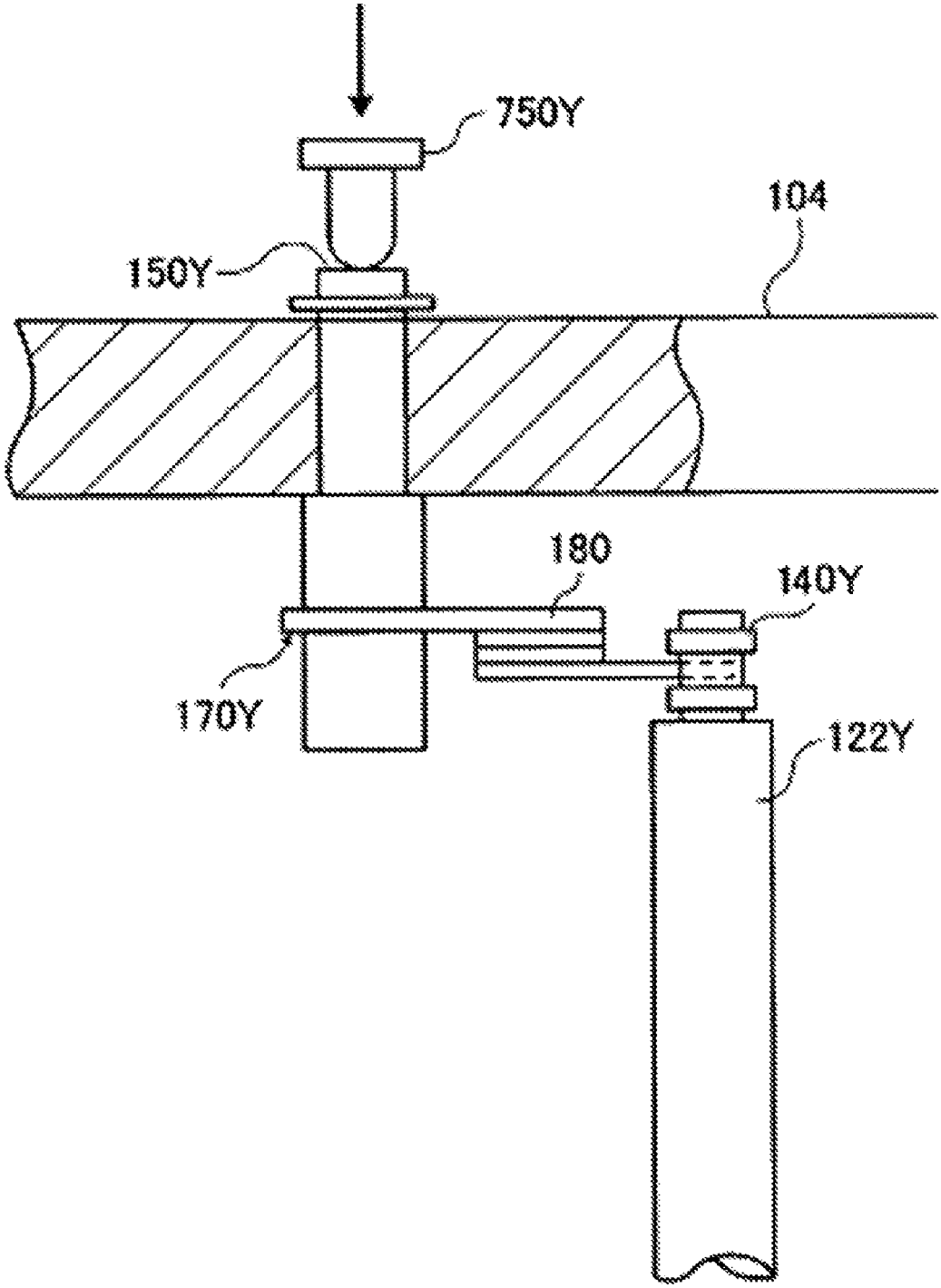
FIG. 20 is a perspective view showing a structure around the first feeding-receiving terminal of the transfer unit shown in FIG. 17.

FIGS. 19 and 20 show a peripheral portion of the conductive part 170Y.

As shown in FIGS. 19 and 20, the first transfer roller 122Y is supported with the bearing 140Y, the bearing 140Y is supported with the bearing support member 172, the bearing support member 172 is supported with the rear side plate 104, thereby the first transfer roller 122Y is supported with the rear side plate 104. Note that the bearing support member 172 is attached to the rear side plate 104 swingably with the position of e.g. the first feeding-receiving terminal 150Y as a center. Further, an urging member 178 which is an elastic member such as a coil spring is attached to the bearing support member 172, and the urging member 178 urges the bearing support member 172 to rotate in a counterclockwise direction in FIG. 19. Accordingly, as the bearing support member 172 is urged to rotate in the counterclockwise direction, the first transfer roller 122Y is urged against the intermediate transfer belt 106.

The conductive part 170Y has a torsion spring 180Y of conductive material. One end side of the torsion spring 180Y is in contact with the first feeding-receiving terminal 150Y such that it is coiled around the first feeding-receiving terminal 150Y, and the other end side is pressed against a lower side of the bearing 140Y having conductivity. In this manner, the first feeding-receiving terminal 150Y and the first transfer roller 122Y are electrically connected with the torsion spring 180Y of conductive material and the bearing 140Y of conductive material. Note that in FIG. 20, for the sake of convenience of illustration, the bearing support member 172 is not shown.

Since the structure where the first transfer rollers 122M, 122C and 122K are supported with the rear side plate 104 is the same as the above-described structure where the first transfer roller 122Y is supported with the rear side plate 104, the explanation of the structure will be omitted. Further, since the structure of the conductive parts 170M, 170C and 170K is the same as that of the conductive part 170Y, the explanations of these conductive parts will be omitted.

As described above, the image forming apparatus 10 has the bearing support member 172 used as a moving member to bring one of the plural first transfer rollers 122Y, 122M, 122C and 122K into contact with or away from one of the photoreceptor drums 52Y, 52M, 52C and 52K. The bearing support member 172 rotates about the first feeding-receiving terminal 150 used as a shaft, thereby moves one of the plural first transfer rollers 122Y, 122M, 122C and 122K. Accordingly, the first transfer roller 122 is positioned with respect to the photoreceptor drum 52 with a simple structure, and electric power feeding to the first transfer roller 122 can be simply performed.

Figure 21:
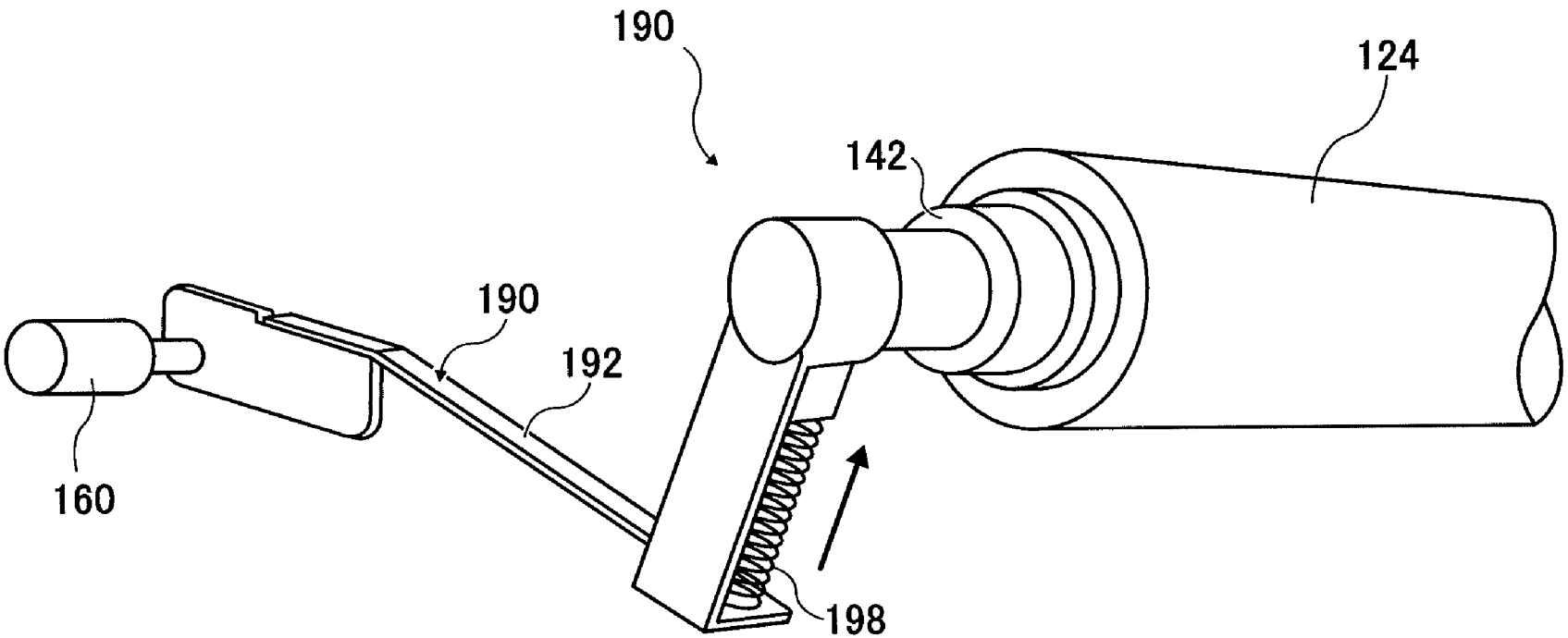
FIG. 21 is a perspective view showing a structure around a second feeding-receiving terminal of the transfer unit shown in FIG. 17.

FIG. 21 shows a peripheral portion of the conductive part 190.

The conductive part 190 has a conductive member 192 of conductive material and a spring member 198 of conductive material. The second feeding-receiving terminal 160 is attached to one end side of the conductive member 192, and the spring member 198 is attached to the other end side of the conductive member 192, further, the side of the spring member 198 opposite to the side attached to the conductive member 192 is pressed against the bearing 142 of conductive material. In this manner, the second feeding-receiving terminal 160 and the second transfer roller 124 are electrically connected with the conductive member 192, the spring member 198 and the bearing 142.

In the image forming apparatus 10 described above, the first transfer roller 122Y and the like are used as first devices, and the second transfer roller 124 is used as a second member. The first feeder line 730Y and the like to feed electric power to the first transfer roller 122Y and the second feeder line 732 to feed electric power to the second transfer roller 124 at a voltage different from that fed with the first feeder line 730 are provided on mutually opposite sides with respect to the second main body member 780 used as a wall surface part having an insulative property. For example, the present invention may be applied to the image forming apparatus 10 such that the first feeder line to feed electric power to the charging roller 53 and the second feeder line 732 to feed electric power to the developing roller 60 at a voltage different from that fed with the first feeder line using the charging roller 53 as a first device and using the developing roller 60 as a second device are provided on mutually opposite sides with respect to the wall surface part having an insulative property.

Figure 22:
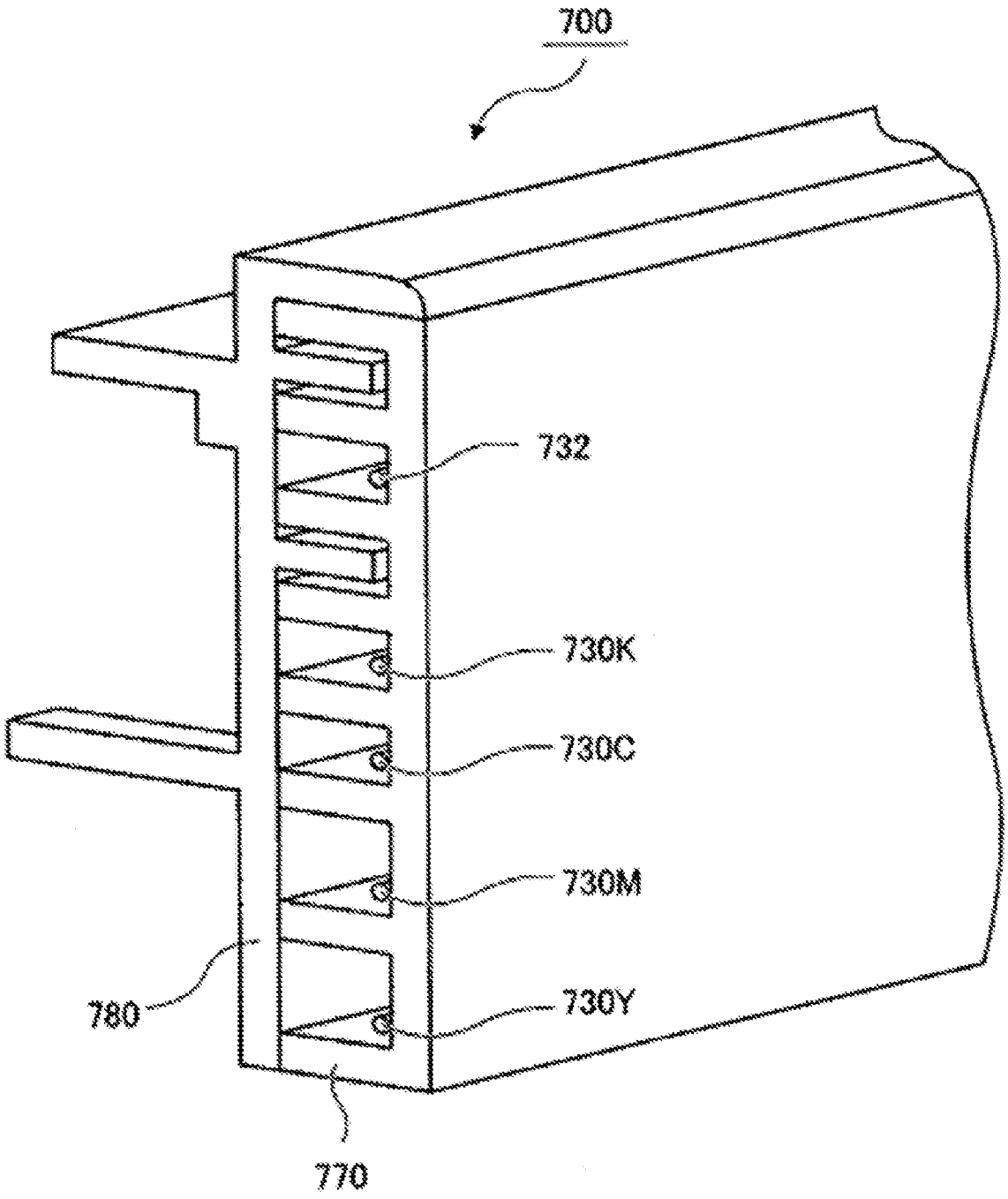
FIG. 22 is a cross-sectional view showing the feeding apparatus according to a comparative example.

FIG. 22 shows the feeding device 700 according to a comparative example.

In the feeding device 700 according to the above-described exemplary embodiment of the present invention (see FIG. 9), the first feeder lines 730Y, 730M, 730C and 730K are supported with the first main body member 770, and the second feeder line 732 is supported with the second main body member 780 which is another member of the first main body member 770. Further, in the feeding device 700 according to the above-described exemplary embodiment of the present invention, the second feeder line 732 is provided on the side of the wall surface 780*a* of the second main body member 780 as a surface on the side opposite to the wall surface 780*b* as a surface opposite to the first feeder lines 730Y, 730M, 730C and 730K. On the other hand, in the feeding device 700 according to the present comparative example, the first feeder lines 730Y, 730M, 730C and 730K and the second feeder line 732 are supported with the first main body member 770. Further, the second feeder line 732 is provided on the same side of the wall surface 780*b* of the second main body member 780 as a surface on the side opposite to the first feeder lines 730Y, 730M, 730C and 730K.

Accordingly, in the feeding device 700 according to the above-described exemplary embodiment of the present invention, in comparison with the feeding device 700 according to the comparative example shown in FIG. 22, the creepage distance between the first feeder lines 730Y, 730M, 730C and 730K and the second feeder line 732 can be increased while upsizing of the apparatus is avoided by e.g. prolonging the feeding device 700 in a vertical direction. Accordingly, excellent electrical insulation between the first feeder lines 730Y, 730M, 730C and 730K and the second feeder line 732 used for power supply at mutually different voltages can be realized without increasing the spatial distance between the first feeder lines 730Y, 730M, 730C and 730K and the second feeder line 732.

As described above, the present invention is applicable to an image forming apparatus such as a copier, a facsimile apparatus and a printer, and a feeding device used in such image forming apparatus.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A feeding apparatus comprising:

an insulative feeding apparatus main body;

a plurality of first feeder lines used for supply of electric power; and a second feeder line used for supply of electric power at a voltage different from a voltage of the electric power respectively supplied with the plurality of first feeder lines, the feeding apparatus main body having:

a first support member that supports the plurality of first feeder lines; and a second support member that supports the second feeder line, and the first support member having:

a wall surface part having a wall surface; and at least one projection projected from the wall surface in a direction crossing the wall surface, the plurality of first feeder lines being provided in space formed between the first support member and the second support member, and mutually partitioned from each other with the at least one projection, and the second feeder line being provided on a side of a surface of the second support member opposite to a surface on a side opposite to the plurality of first feeder lines.

2. The feeding apparatus according to claim 1, wherein a plurality of first holding grooves that respectively support the plurality of first feeder lines are formed in the first support member, a second holding groove that holds the second feeder line is formed in the second support member, and the apparatus further comprises at least one of a first movement suppressing part that suppresses movement of any one of the plurality of first feeder lines in a direction to move from any one of the plurality of first holding grooves, and a second movement suppressing part that suppresses movement of the second feeder line in a direction to remove from the second holding groove.

3. An image forming apparatus comprising:

a first device used for at least one of image formation and recording medium conveyance;

a second device used for at least one of image formation and recording medium conveyance; and a feeding device that supplies electric power to the first device and the second device, the feeding device having:

an insulative feeding device main body;

a plurality of first feeder lines used for supply of electric power to the first device; and a second feeder line used for supply of electric power at a voltage different from a voltage of the electric power respectively supplied to the first device with the plurality of first feeder lines, to the second device, and the feeding device main body having:

a first support member that supports the plurality of first feeder lines; and a second support member that supports the second feeder line, the first support member having:

a wall surface part having a wall surface; and at least one projection projected from the wall surface in a direction crossing the wall surface, the plurality of first feeder lines being provided in space formed between the first support member and the second support member, and mutually partitioned from each other with the at least one projection, and the second feeder line being provided on a side of a surface of the second support member opposite to a surface on a side opposite to the plurality of first feeder lines.

4. An image forming apparatus comprising:

a plurality of image holders that hold an image;

a transfer body where the images held with the plurality of image holders are respectively transferred;

a plurality of first transfer devices that respectively transfer the images from the plurality of image holders to the transfer body;

a second transfer device that transfers the images from the transfer body to a recording medium; and a feeding device that supplies electric power to the plurality of first transfer devices and the second transfer device, the feeding device having:

an insulative feeding device main body;

a plurality of first feeder lines used for supply of electric power respectively to the plurality of first transfer devices; and a second feeder line used for supply of electric power at a voltage different from a voltage of the electric power respectively supplied to the first transfer devices with the plurality of first feeder lines, to the second device, and the feeding device main body having:

a first support member that supports the plurality of first feeder lines; and a second support member that supports the second feeder line, the first support member having:

a wall surface part having a wall surface; and at least one projection projected from the wall surface in a direction crossing the wall surface, the plurality of first feeder lines being provided in space between the first support member and the second support member, and mutually partitioned from each other with the at least one projection, the second feeder line being provided on a side of a surface of the second support member opposite to a surface on a side opposite to the plurality of first feeder lines.

5. The image forming apparatus according to claim 4, further comprising:

an image forming apparatus main body; and an attachment/removal structure attached/removed in the image forming apparatus main body, wherein the attachment/removal structure has the plurality of first transfer devices and the second transfer device.

6. The image forming apparatus according to claim 5, wherein the feeding device has:

a plurality of first feeding terminals connected to the respective plurality of first feeder lines; and a second feeding terminal connected to the second feeder line, and the attachment/removal structure has:

a plurality of first feeding-receiving terminals, respectively in contact with the plurality of first transfer devices, that respectively come in contact with the plurality of first feeding terminals when the attachment/removal structure is inserted in the image forming apparatus main body and respectively fed with electric power from the plurality of first feeding terminals; and a second feeding-receiving terminal, connected to the second transfer device, that comes in contact with the second feeding terminal when the attachment/removal structure is inserted in the image forming apparatus main body and is fed with electric power from the second feeding terminal.

7. The image forming apparatus according to claim 6, wherein the image forming apparatus main body has a side plate provided on a side where the attachment/removal structure is attached/removed with respect to the attachment/removal structure, and the attachment/removal structure is pressed against the side plate.

8. The image forming apparatus according to claim 7, further comprising a moving member that brings one of the plurality of first transfer devices into contact with or away from one of the plurality of image holders, wherein the moving member rotates about a rotational shaft, thereby moves one of the plurality of first transfer devices, and one of the plurality of first feeding-receiving terminals is provided on the rotational shaft.

9. The image forming apparatus according to claim 6, further comprising a moving member that brings one of the plurality of first transfer devices into contact with or away from one of the plurality of image holders, wherein the moving member rotates about a rotational shaft, thereby moves one of the plurality of first transfer devices, and one of the plurality of first feeding-receiving terminals is provided on the rotational shaft.

10. The image forming apparatus according to claim 5, wherein the image forming apparatus main body has a side plate provided on a side where the attachment/removal structure is attached/removed with respect to the attachment/removal structure, and the attachment/removal structure is pressed against the side plate.

11. The image forming apparatus according to claim 10, further comprising a moving member that brings one of the plurality of first transfer devices into contact with or away from one of the plurality of image holders, wherein the moving member rotates about a rotational shaft, thereby moves one of the plurality of first transfer devices, and one of the plurality of first feeding-receiving terminals is provided on the rotational shaft.

* * * * *